US012150491B2

(12) United States Patent
Stull

(10) Patent No.: US 12,150,491 B2
(45) Date of Patent: Nov. 26, 2024

(54) THERAPEUTIC SOCK WITH ONE OR MORE ELASTOMERIC BANDS

(71) Applicant: Jared Daniel Stull, Sylva, NC (US)

(72) Inventor: Jared Daniel Stull, Sylva, NC (US)

( * ) Notice: Subject to any disclaimer, the term of this patent is extended or adjusted under 35 U.S.C. 154(b) by 102 days.

(21) Appl. No.: 17/227,361

(22) Filed: Apr. 11, 2021

(65) Prior Publication Data

US 2022/0322756 A1 Oct. 13, 2022

(51) Int. Cl.
*A41B 11/02* (2006.01)

(52) U.S. Cl.
CPC ..... *A41B 11/02* (2013.01)

(58) Field of Classification Search
CPC ... A41B 11/003; A41B 11/005; A41B 11/008; A41B 11/02; A41B 11/04; A41B 11/12; A41B 11/121; A41B 11/123; A41B 11/125; A41B 11/126; A41B 11/14; A41B 11/143; A41B 2300/22; A41B 2400/32; A41B 2400/38; A41B 2400/80; A41B 2400/82; A61F 5/0111; A61F 5/0127; A61F 5/019; A61F 5/0195; D04B 1/265; A43B 7/26
USPC ..... 2/239, 240, 241; 602/30, 65
See application file for complete search history.

(56) References Cited

U.S. PATENT DOCUMENTS 2,596,038 A * 5/1952 Mayer ..... A61F 5/019 602/30
3,049,120 A * 8/1962 Marcus ..... A61F 5/019 602/30
5,445,598 A * 8/1995 Nguyen-Senderowicz ..... A61F 13/066 602/65
5,473,781 A 12/1995 Greenberg
5,772,621 A * 6/1998 Unruh ..... A61F 5/019 602/65
6,708,348 B1 3/2004 Romay
6,908,445 B2 * 6/2005 Watts ..... A61F 5/0111 602/5
2001/0041855 A1 * 11/2001 Voskuilen ..... A61F 5/0111 602/65
2007/0074334 A1 * 4/2007 Steel ..... A43B 7/26 36/9 R
2007/0094892 A1 * 5/2007 Craig ..... A41B 11/02 36/10
2008/0155731 A1 * 7/2008 Kasahara ..... D04B 1/265 2/241

(Continued)

OTHER PUBLICATIONS

International Search Report and Written Opinion for corresponding International Patent Application No. PCT/US22/24314, dated Aug. 3, 2022.

*Primary Examiner* — Heather Mangine
*Assistant Examiner* — Matthew R Marchewka
(74) *Attorney, Agent, or Firm* — Charlotte C. Wilson

(57) ABSTRACT

A therapeutic sock includes a knitted body having a top, a bottom opposite the top, an inside side connecting the top to the bottom, an outside side opposite the inside side and connecting the top to the bottom, a heel portion, a toe portion, and an opening into which a wearer inserts his or her foot. At least one elastomeric band is disposed within the knitted body and positioned to strengthen, stretch, or support one or more muscle groups of the foot of the wearer. The at least one elastomeric band is disposed opposite a line of pull of the one or more muscle groups. In some embodiments, one or more reinforcement bands may be used in conjunction with the at least one elastomeric band.

21 Claims, 29 Drawing Sheets

(56) References Cited

U.S. PATENT DOCUMENTS

| | | | | |
|---|---|---|---|---|
| 2008/0295230 | A1* | 12/2008 | Wright | A41D 31/18 2/92 |
| 2009/0013450 | A1* | 1/2009 | Lambertz | A41B 11/003 602/65 |
| 2009/0165190 | A1* | 7/2009 | Araki | A61F 13/064 66/178 A |
| 2010/0106110 | A1* | 4/2010 | De Luca | A61F 5/019 2/241 |
| 2014/0053610 | A1* | 2/2014 | Fukui | D04B 1/102 66/178 A |
| 2014/0207042 | A1* | 7/2014 | Amanatullah | A61F 5/042 602/28 |
| 2016/0081836 | A1* | 3/2016 | Sawle | A41B 11/007 2/239 |
| 2018/0021199 | A1* | 1/2018 | Halbrecht | A61F 5/0127 601/27 |
| 2018/0051401 | A1* | 2/2018 | Giorgini | D04B 1/24 |
| 2018/0116853 | A1* | 5/2018 | Jones | A61F 5/34 |
| 2018/0368484 | A1* | 12/2018 | Baravarian | A41B 11/02 |
| 2020/0100927 | A1* | 4/2020 | Eugene | A61F 5/019 |
| 2021/0145079 | A1* | 5/2021 | De Freitas Silva | A41B 11/003 |
| 2021/0235775 | A1* | 8/2021 | Lambertz | A61F 13/08 |

* cited by examiner

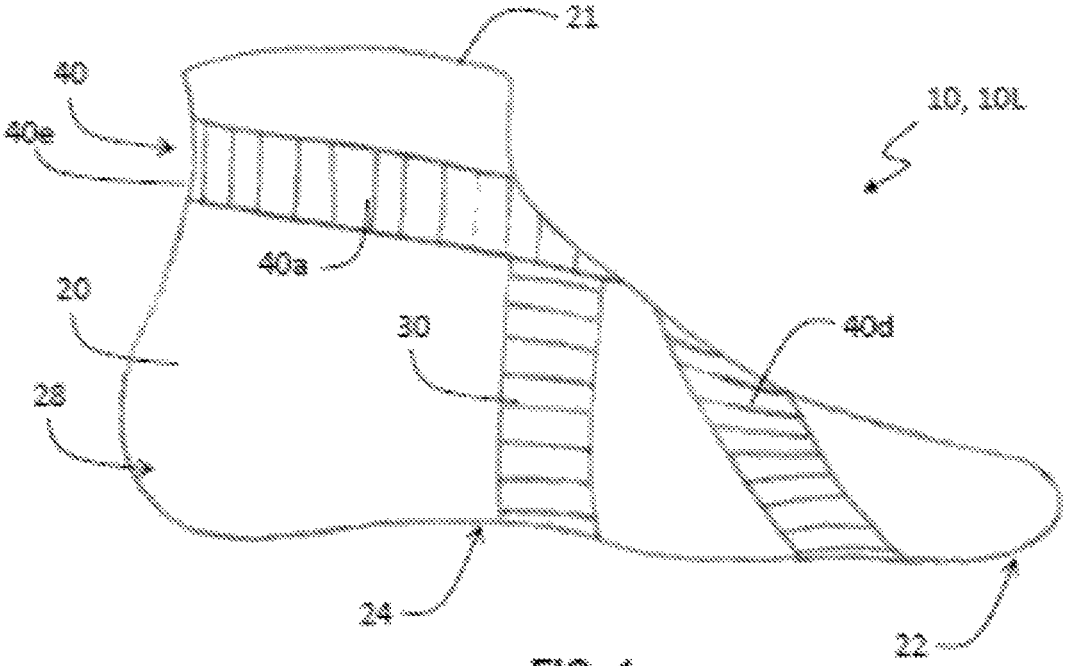
— FIG. 1 —
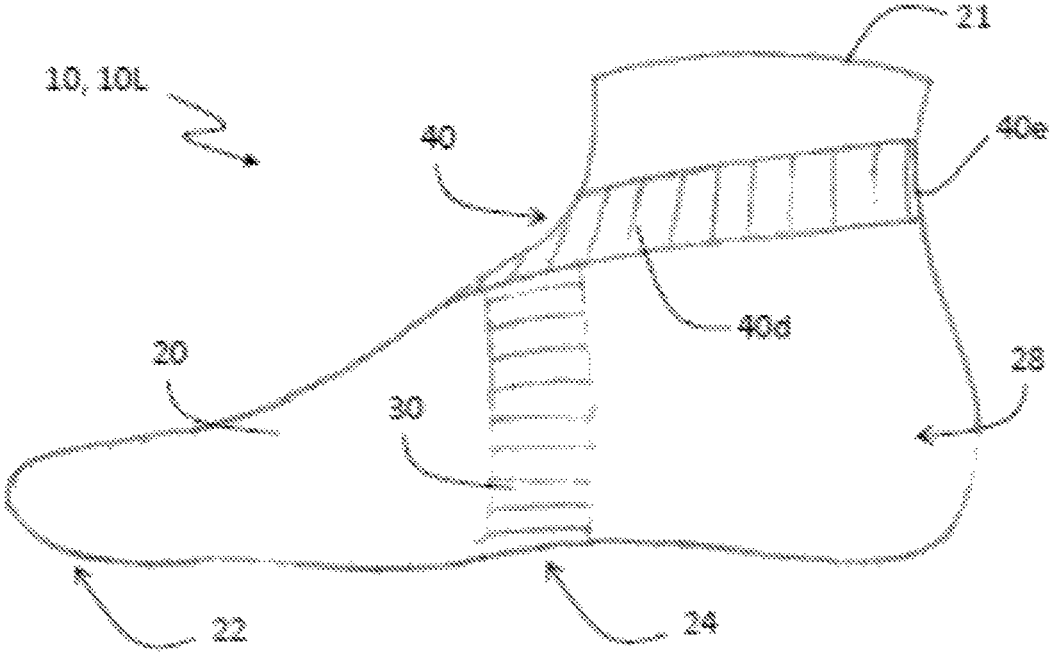
— FIG. 2 —

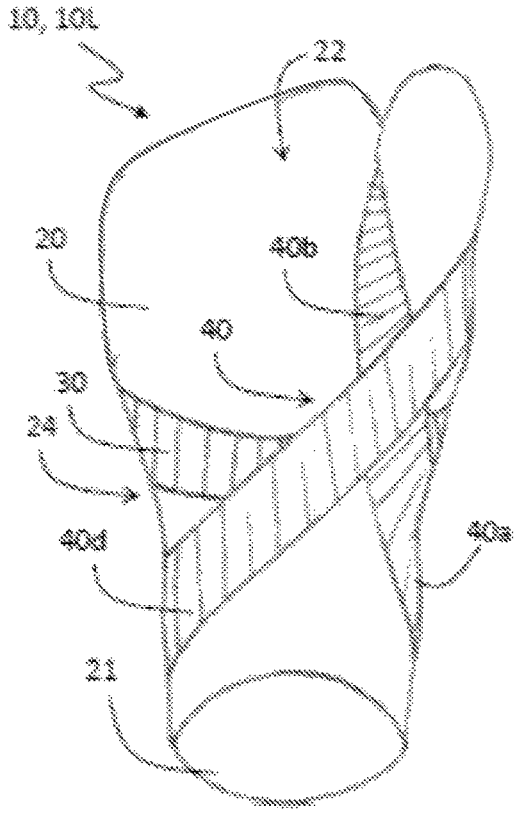
— FIG. 3 —
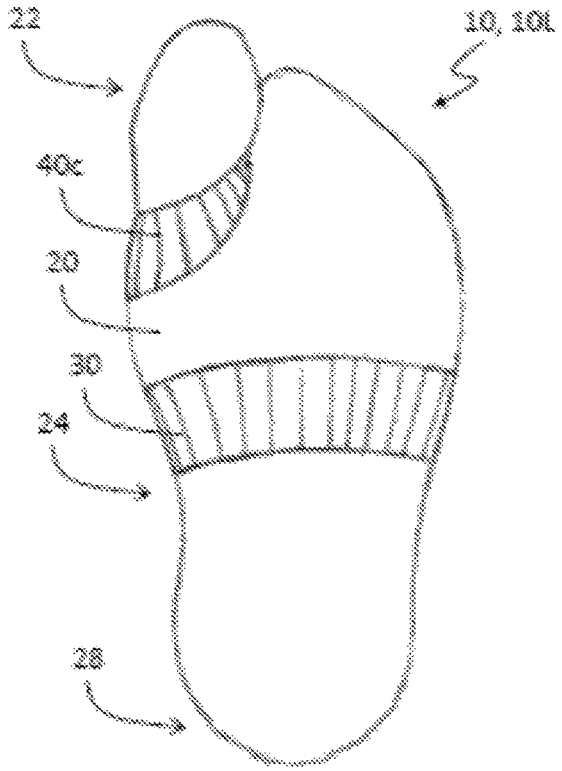
— FIG. 4 —
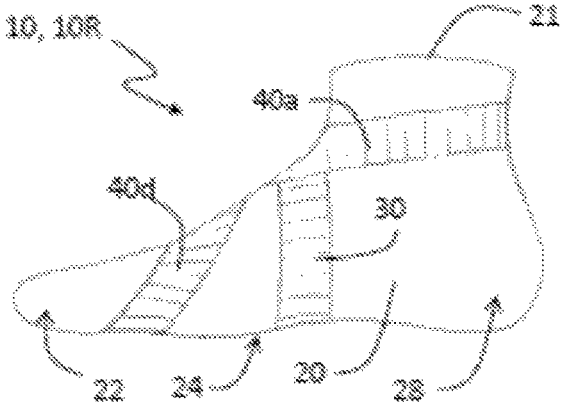
— FIG. 5 —
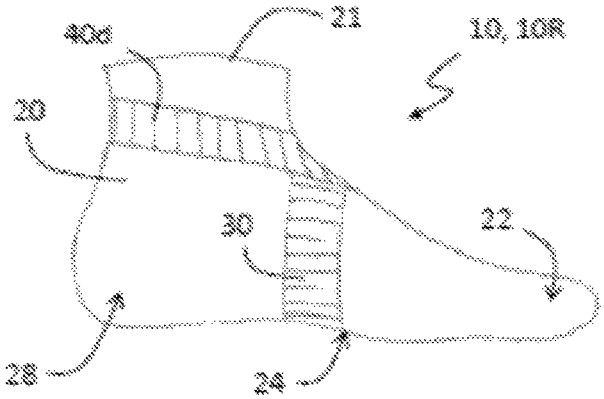
— FIG. 6 —

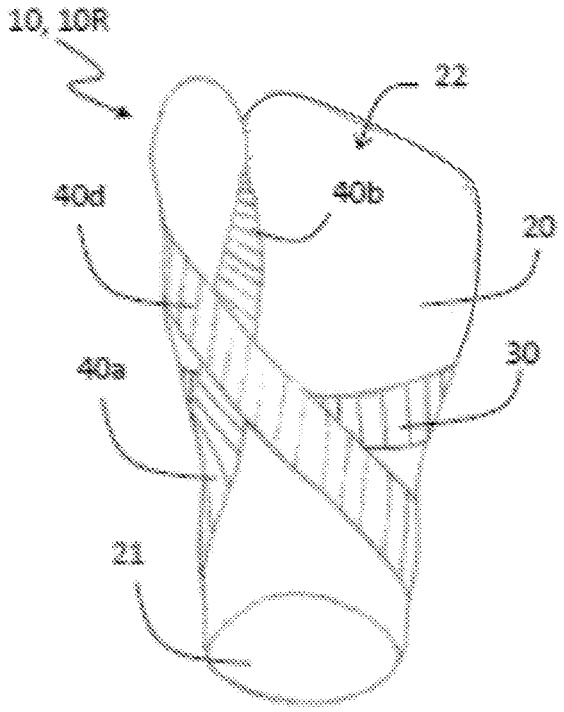
— FIG. 7 —
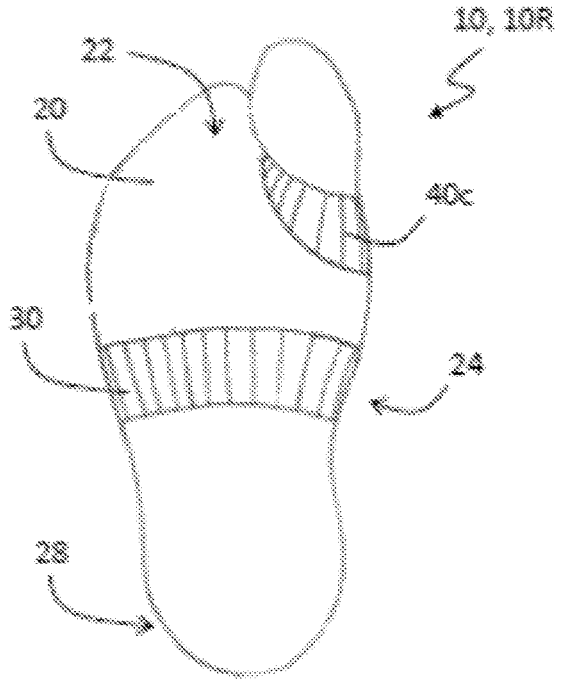
— FIG. 8 —
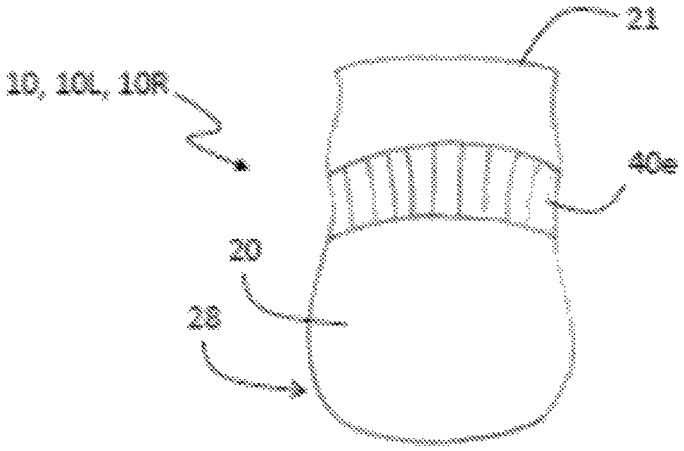
— FIG. 9 —

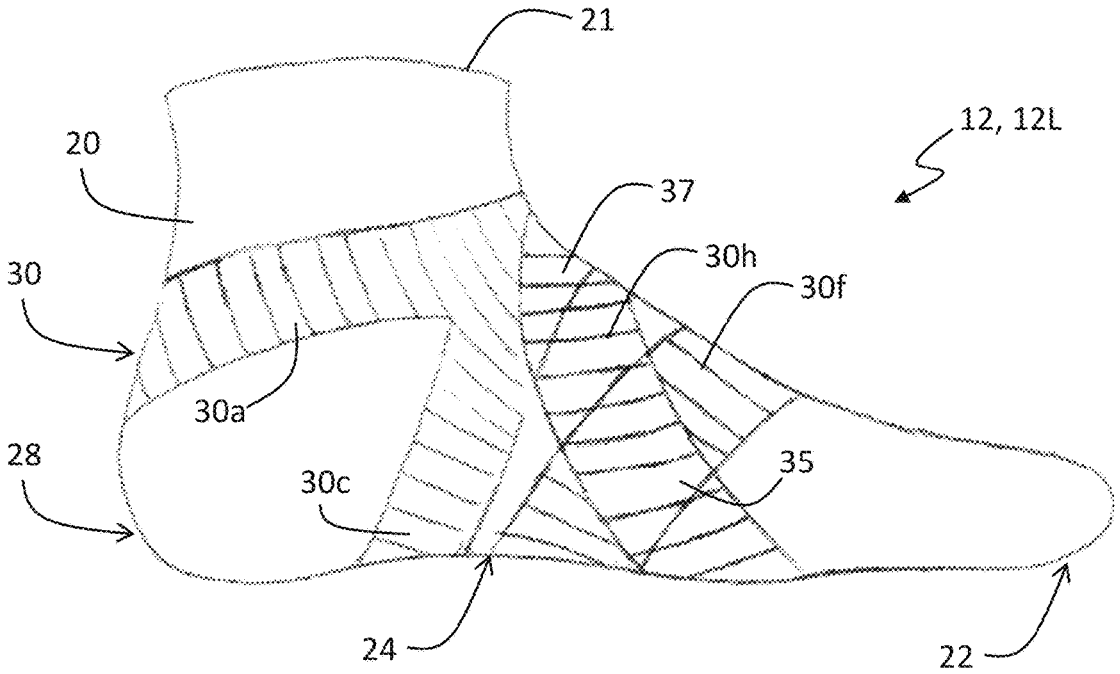
— FIG. 10 —
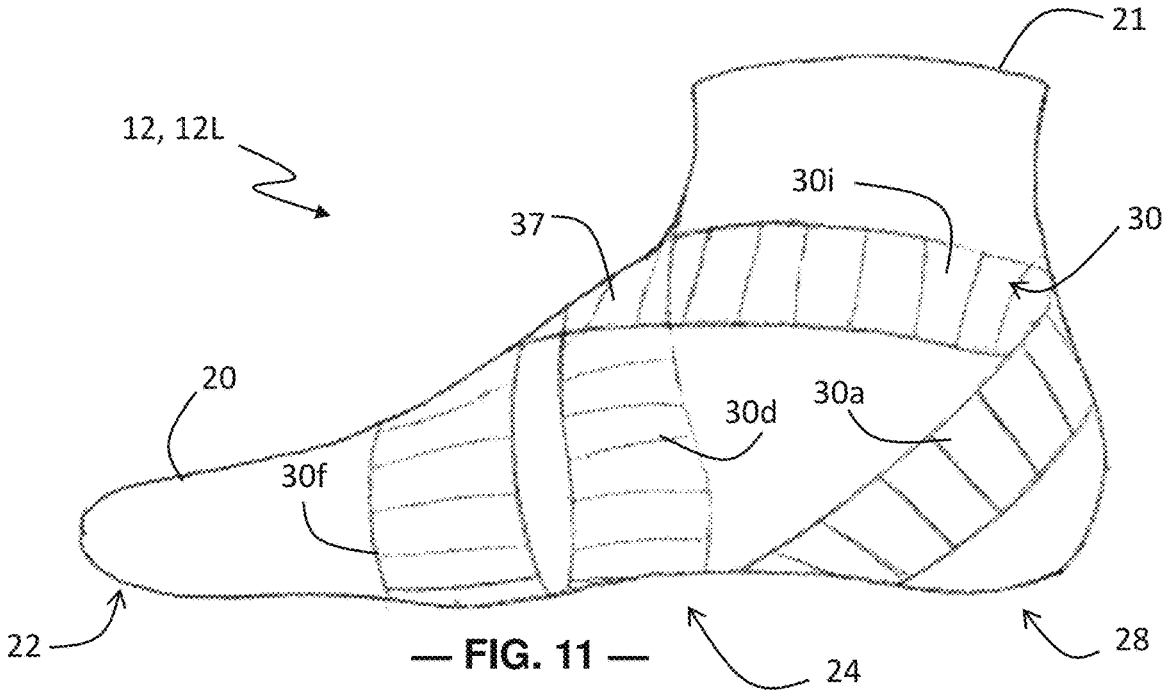
— FIG. 11 —

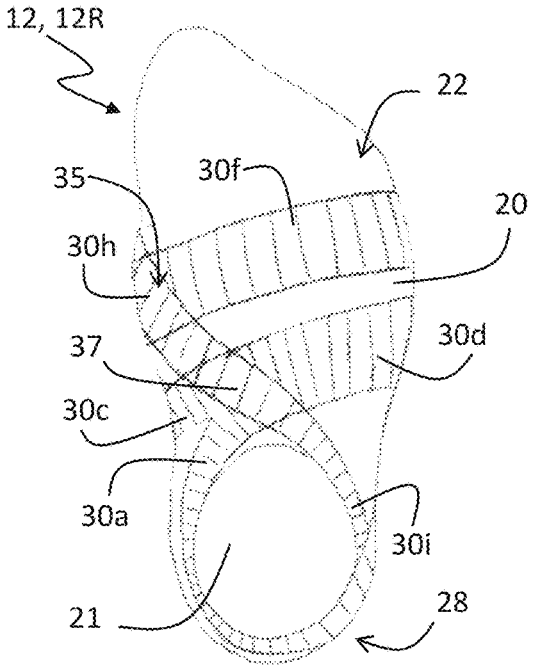
— FIG. 12 —
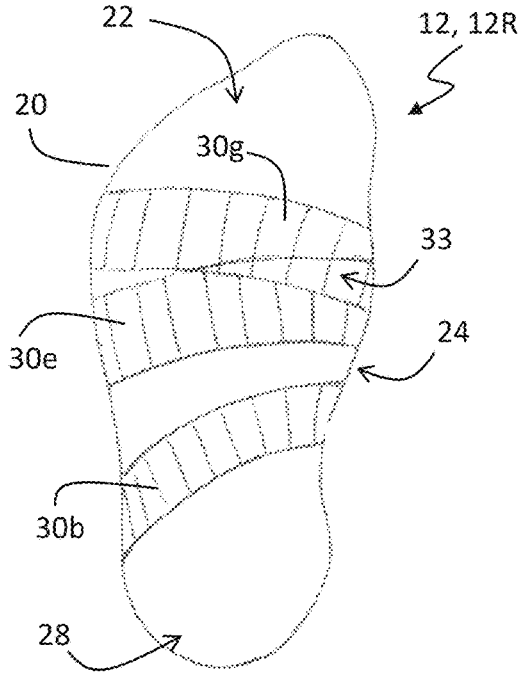
— FIG. 13 —
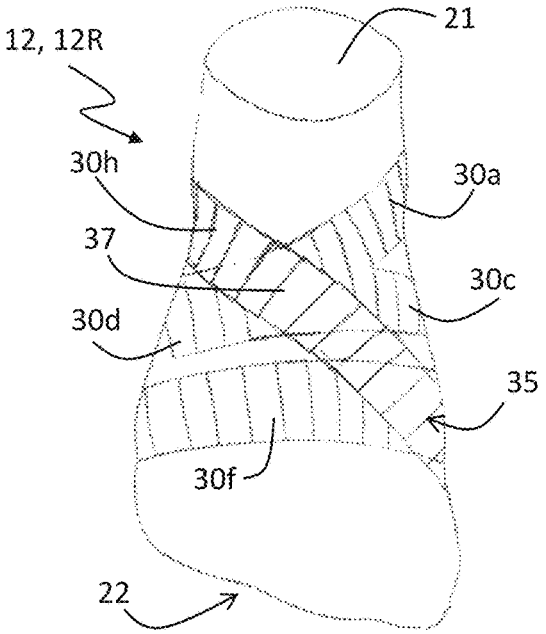
— FIG. 14 —
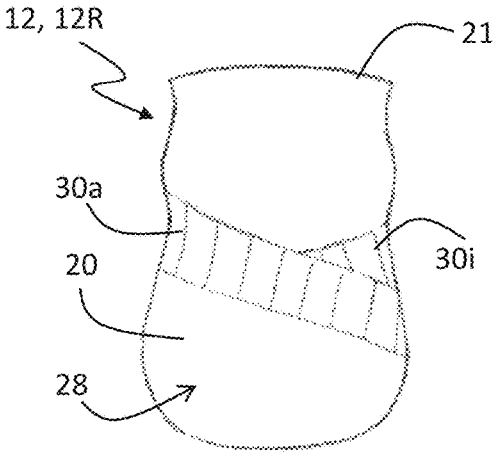
— FIG. 15 —

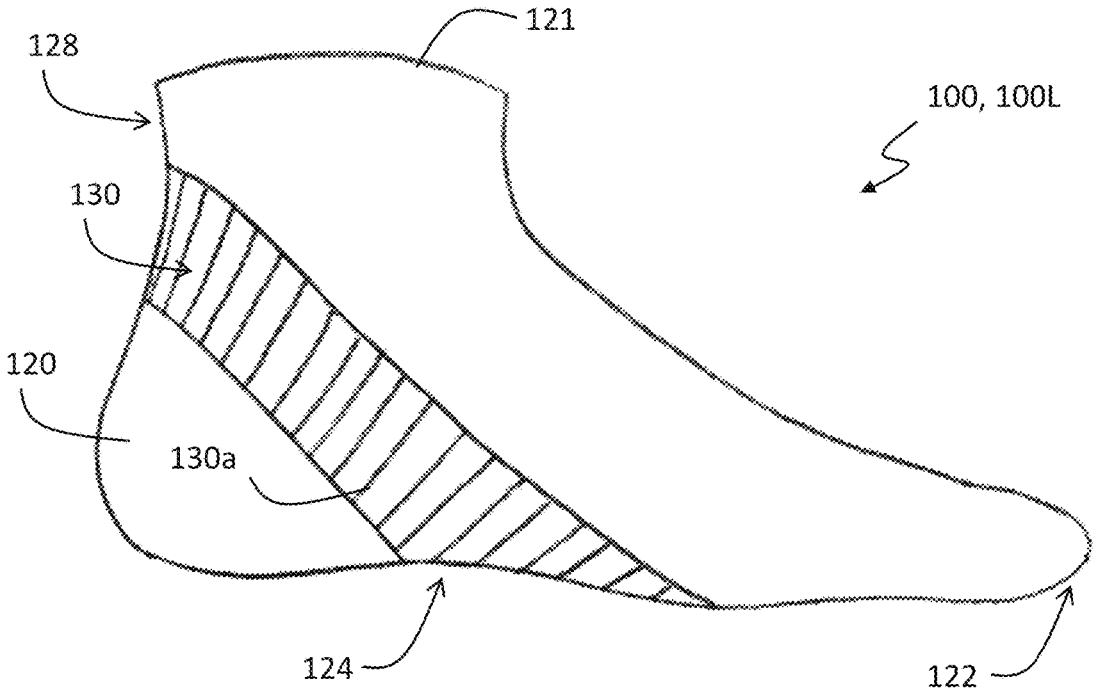
— FIG. 16 —
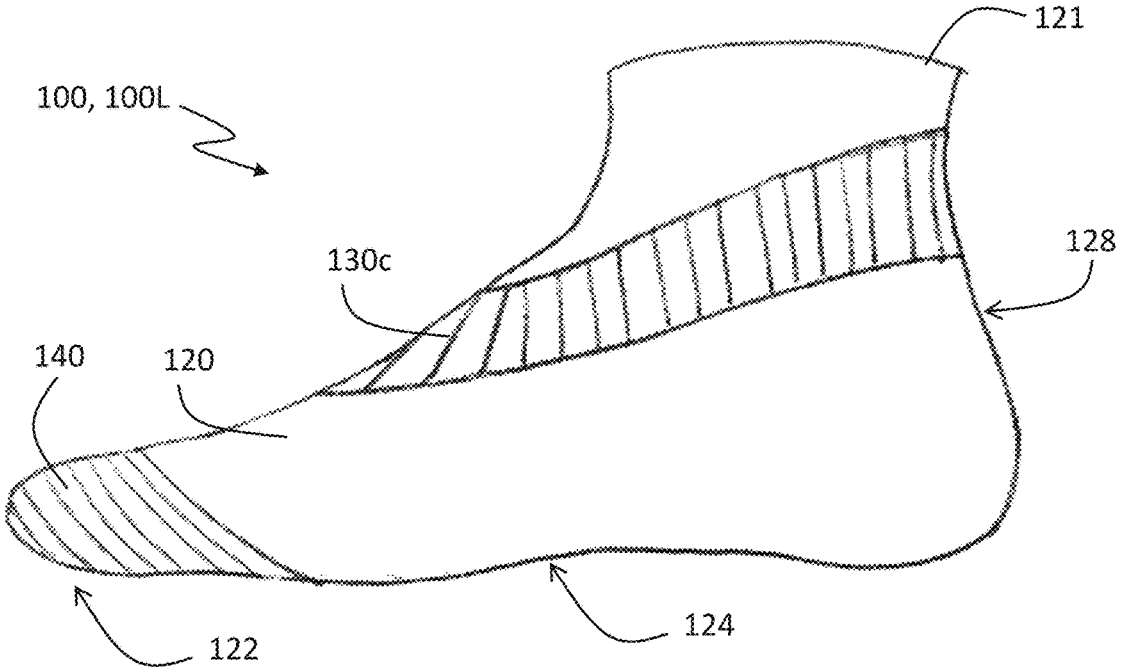
— FIG. 17 —

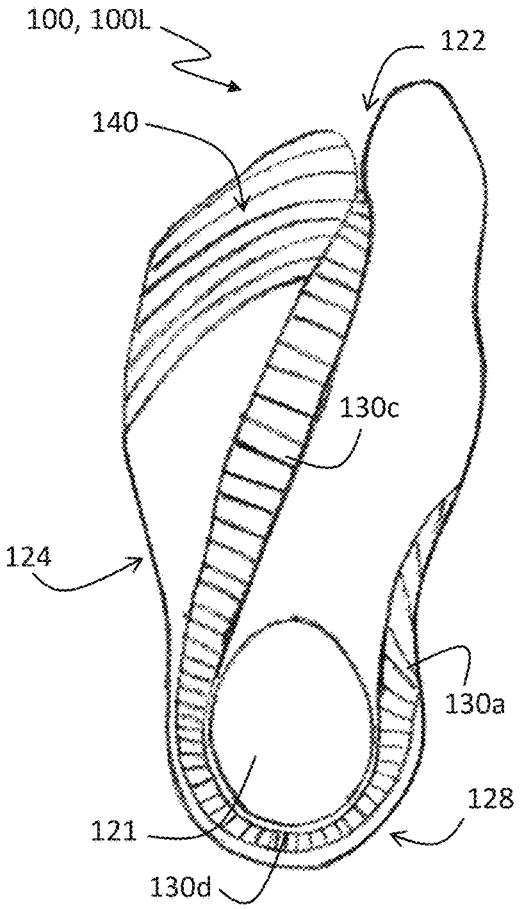
— FIG. 18 —
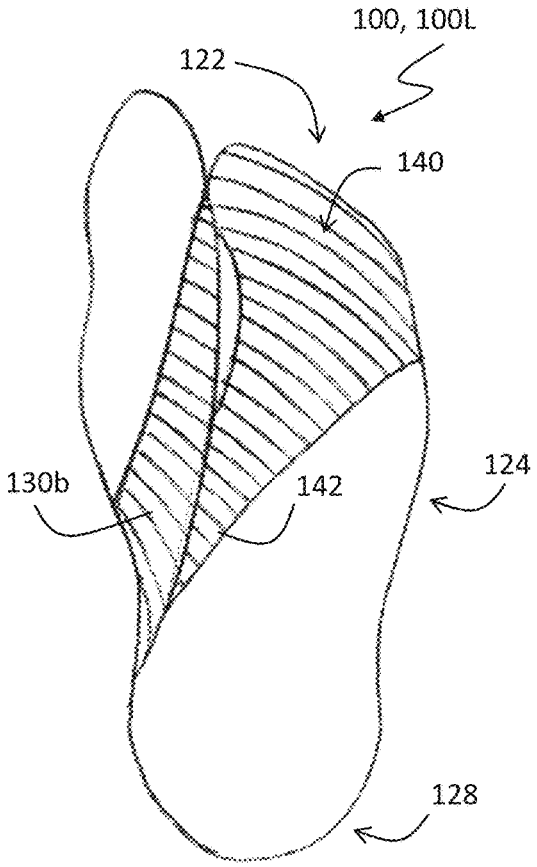
— FIG. 19 —
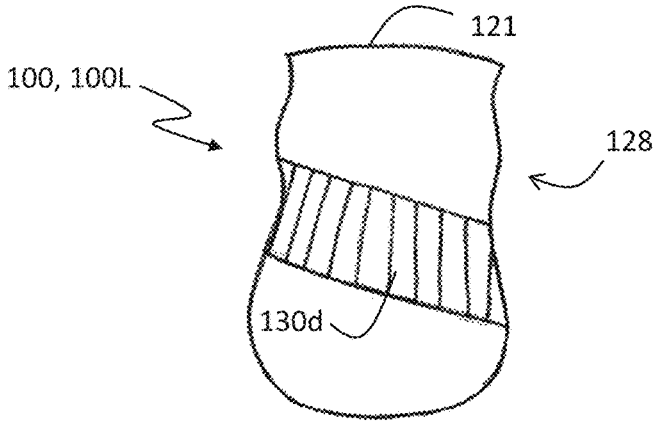
— FIG. 20 —

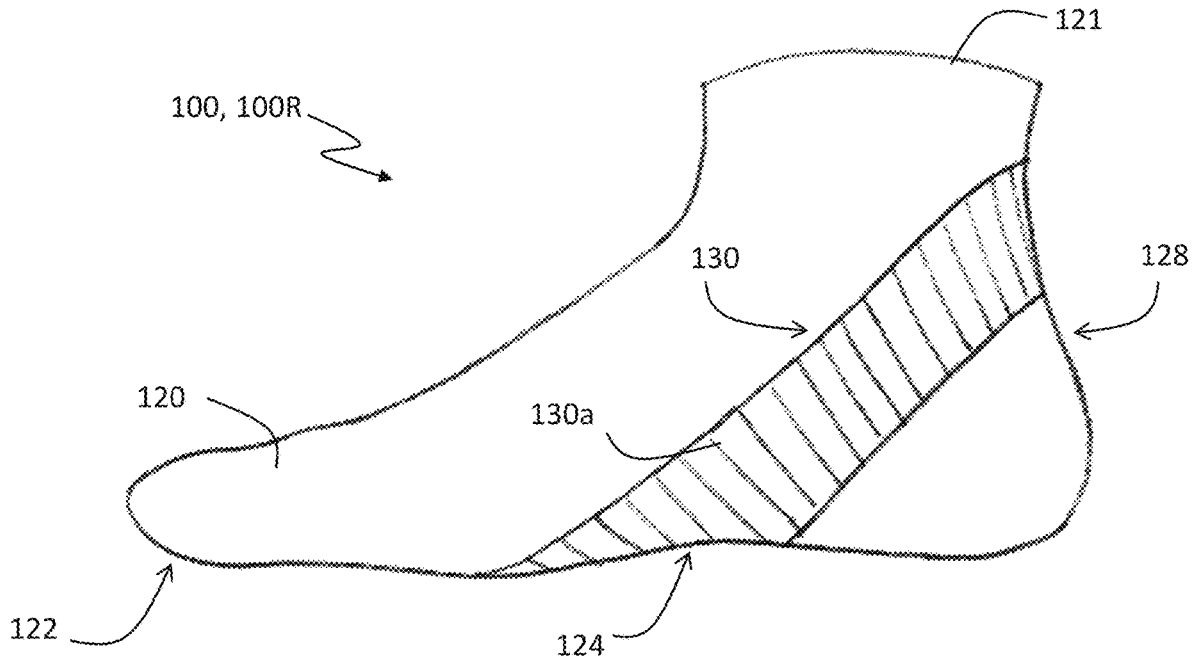
— FIG. 21 —
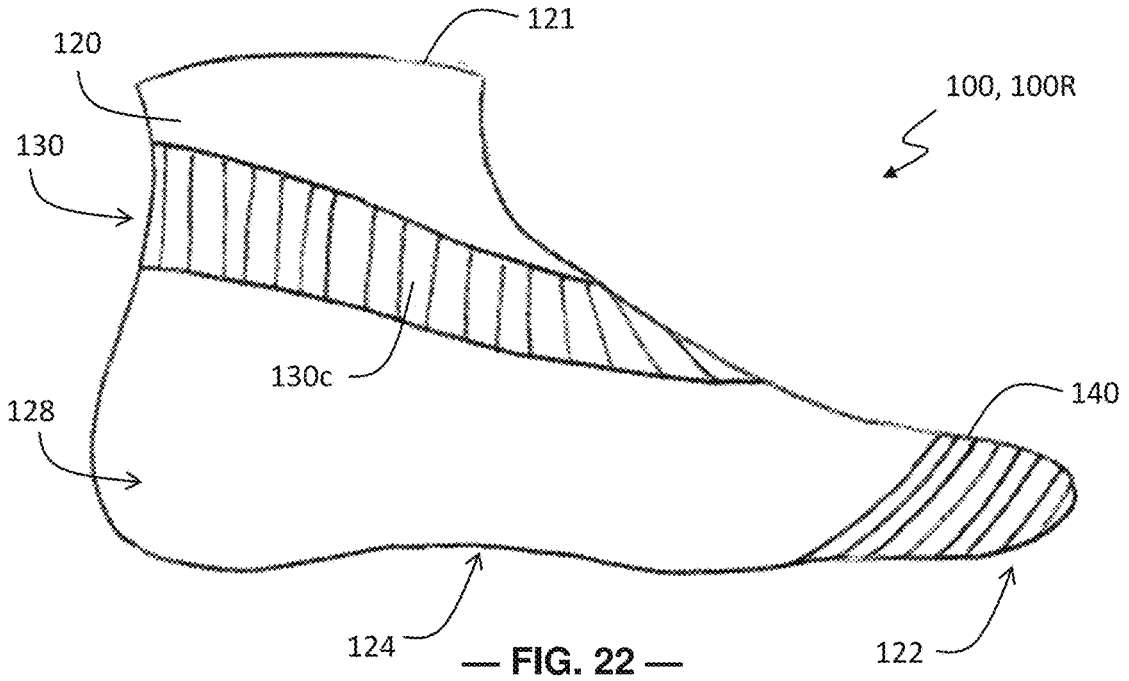
— FIG. 22 —

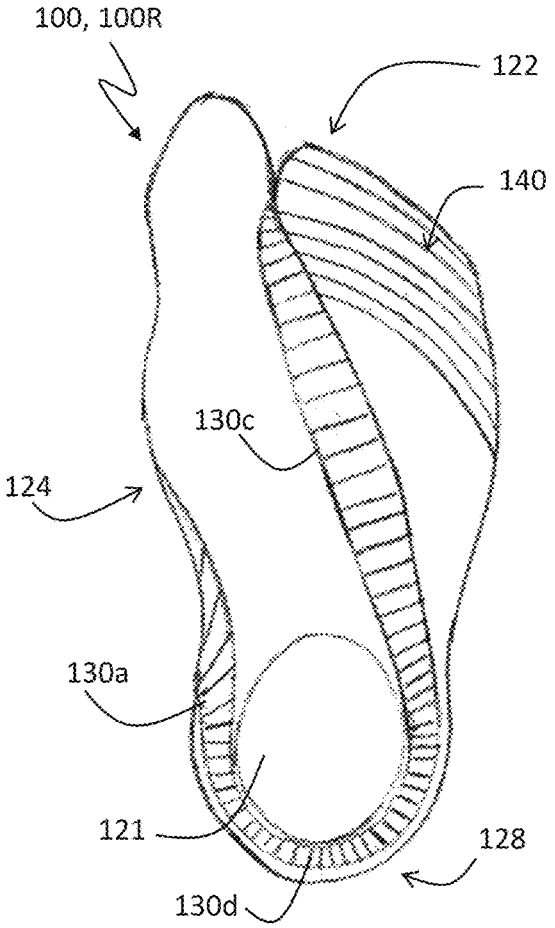
— FIG. 23 —
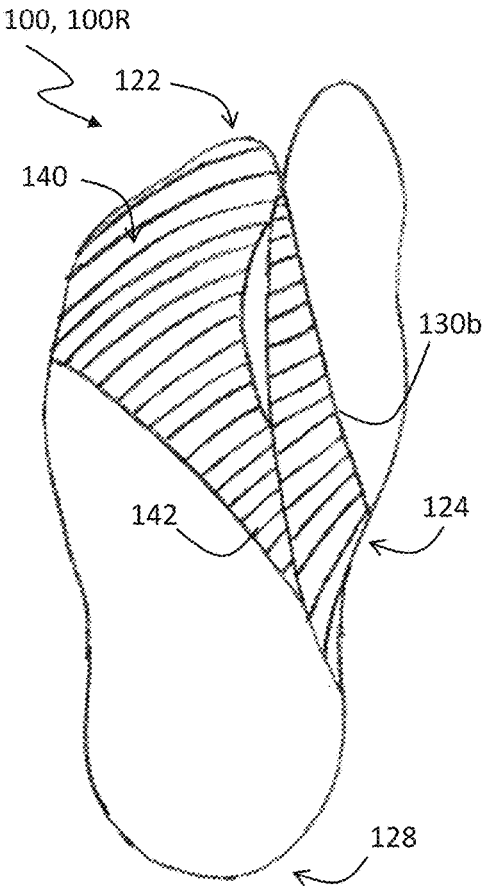
— FIG. 24 —
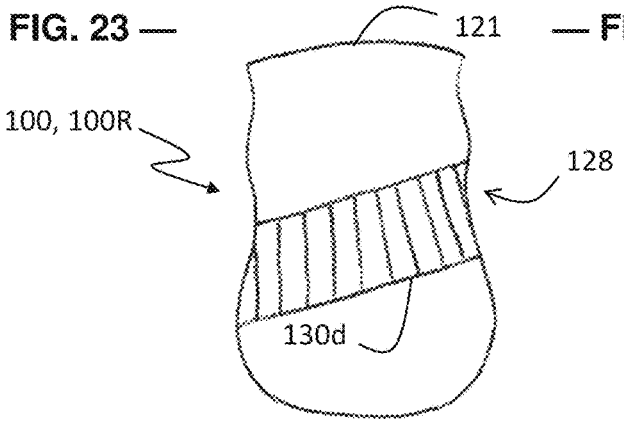
— FIG. 25 —

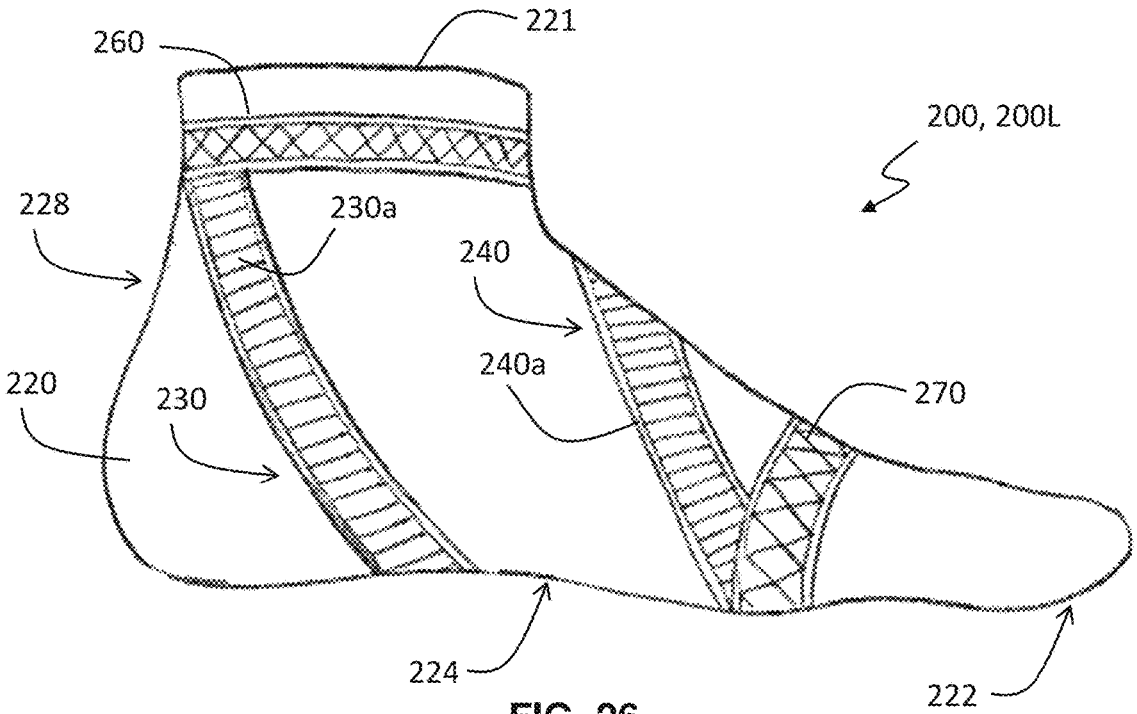
— FIG. 26 —
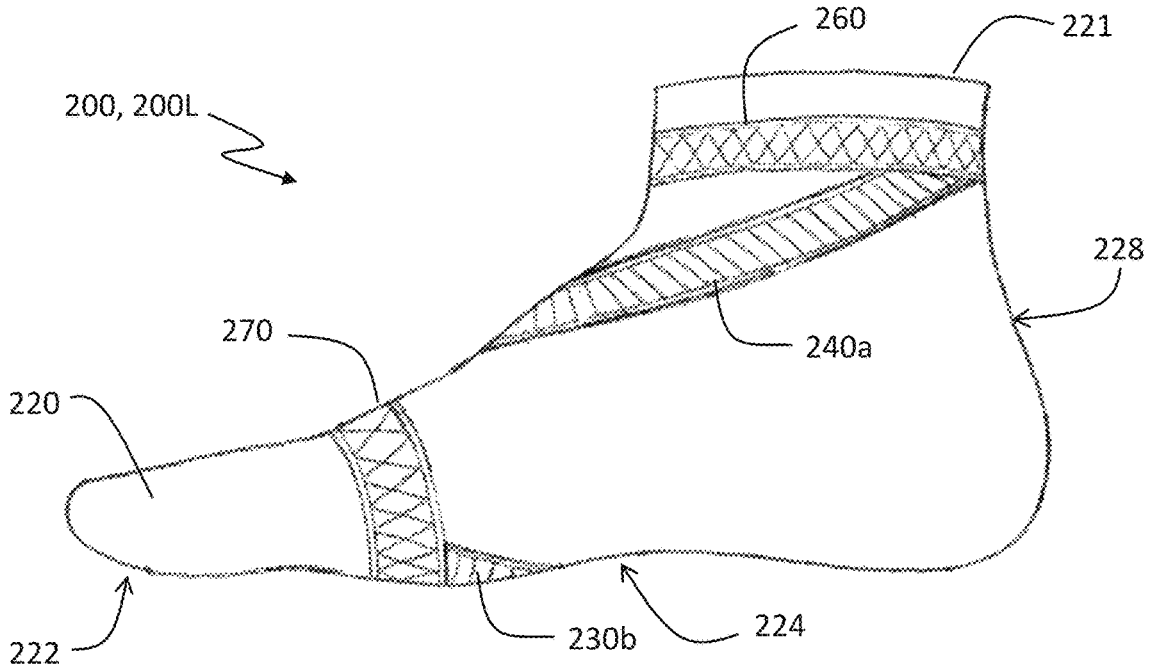
— FIG. 27 —

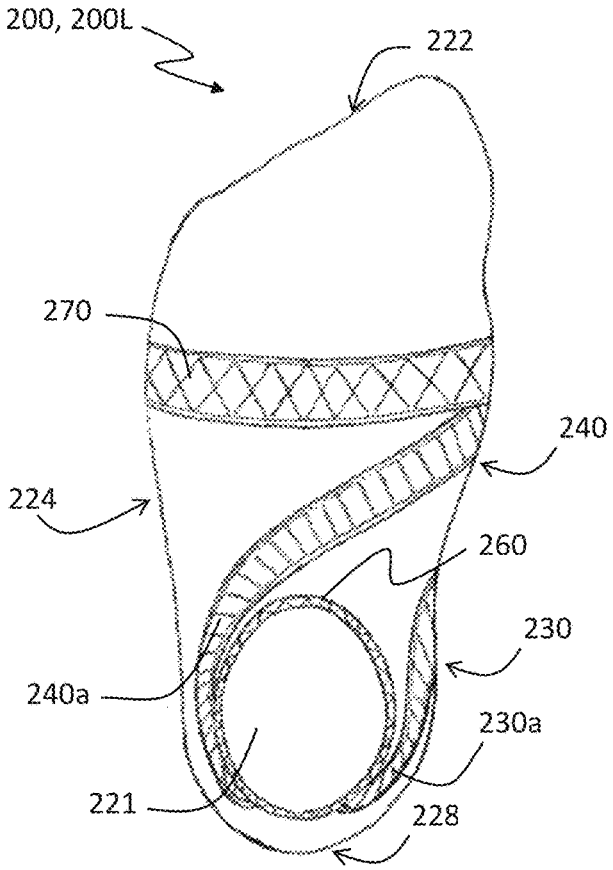
— FIG. 28 —
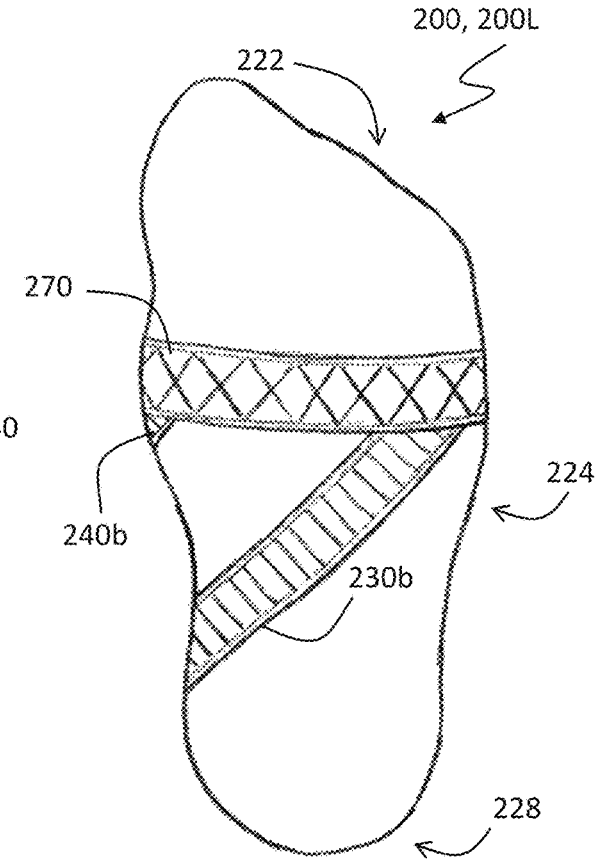
— FIG. 29 —
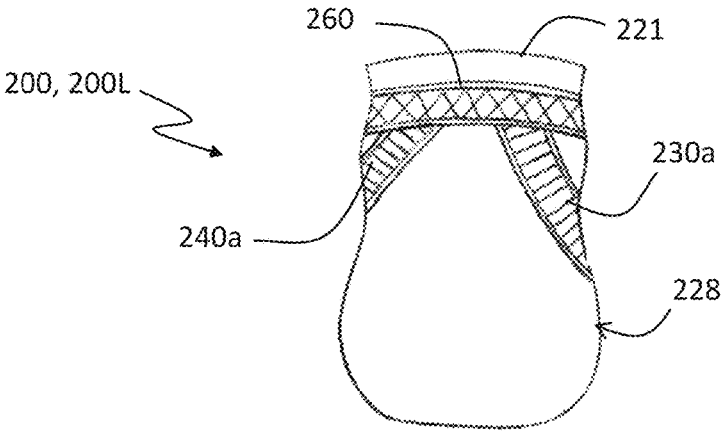
— FIG. 30 —

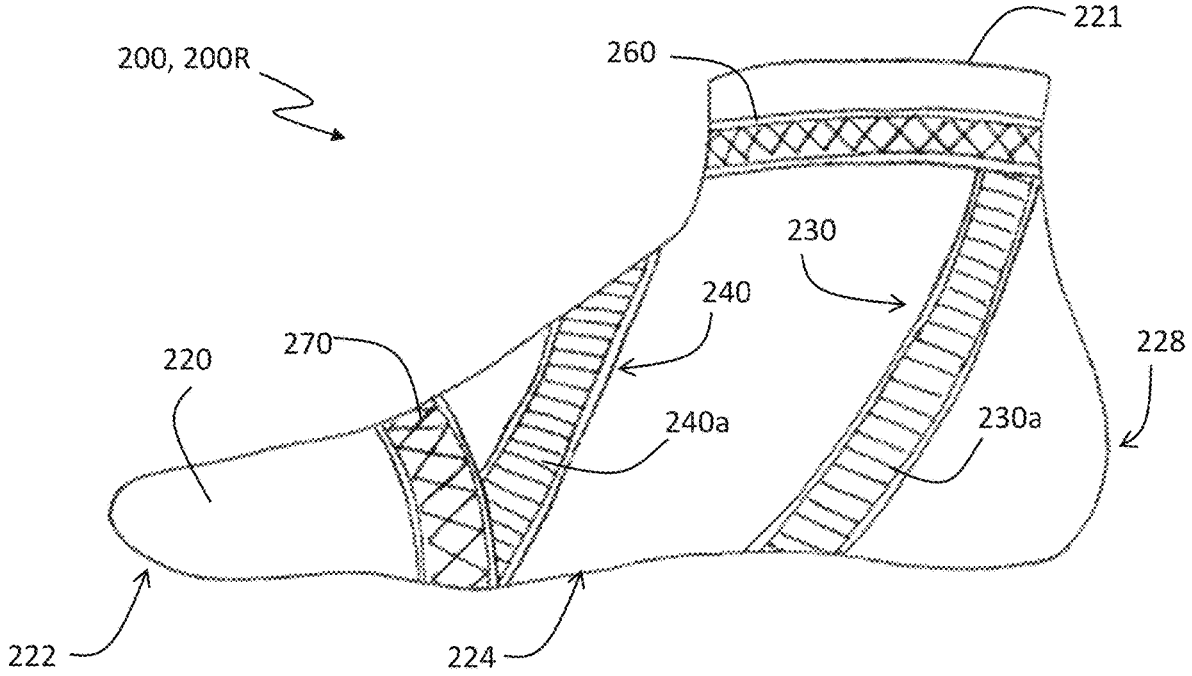
— FIG. 31 —
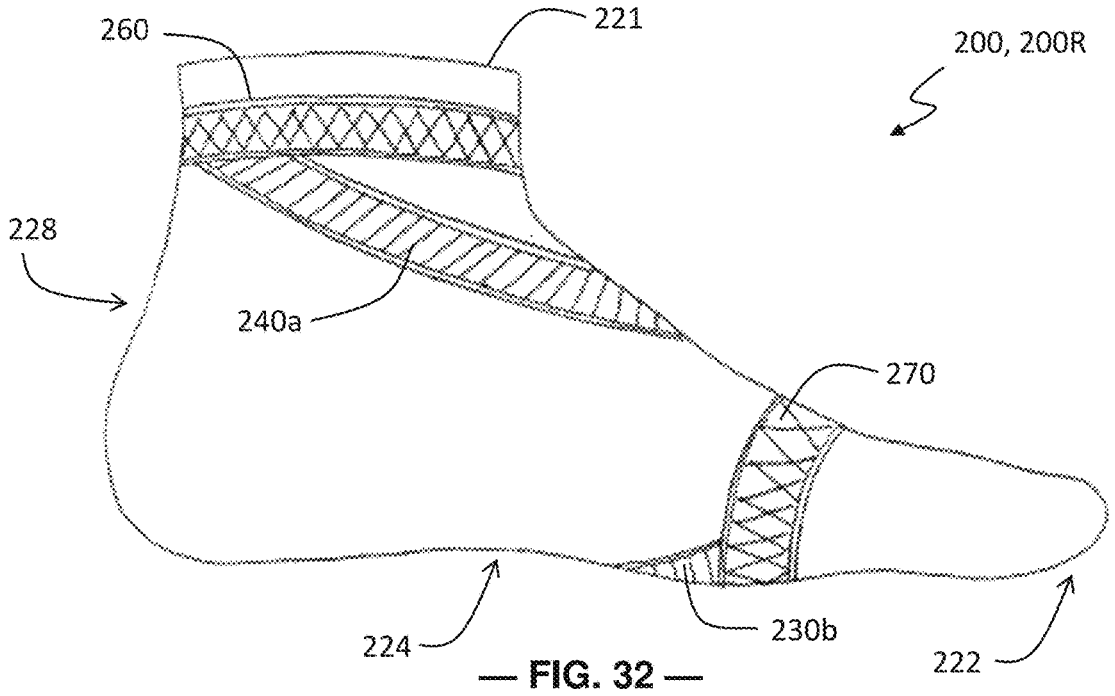
— FIG. 32 —

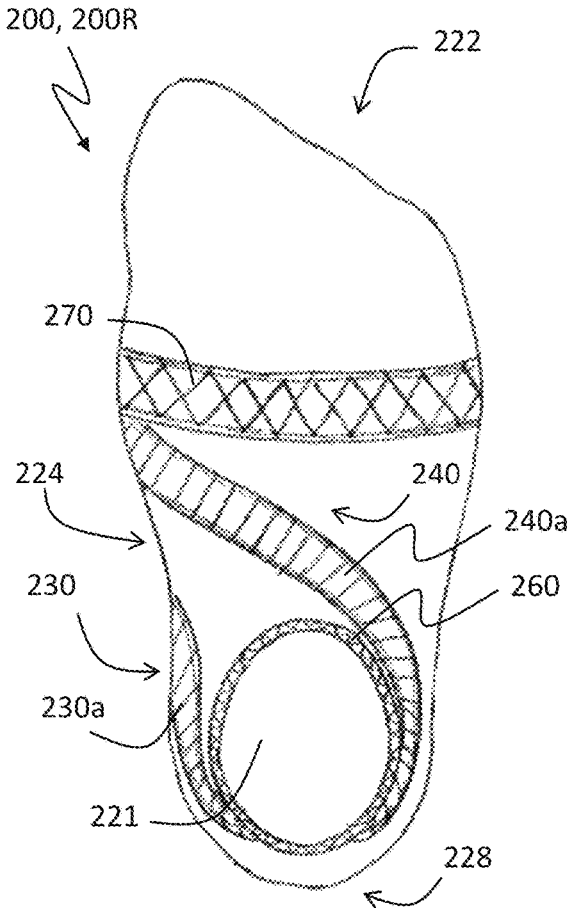
— FIG. 33 —
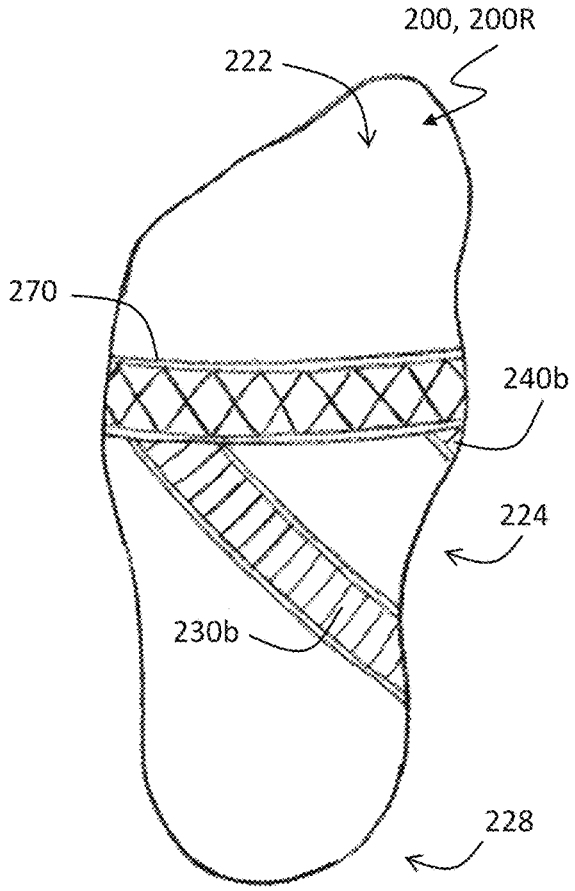
— FIG. 34 —
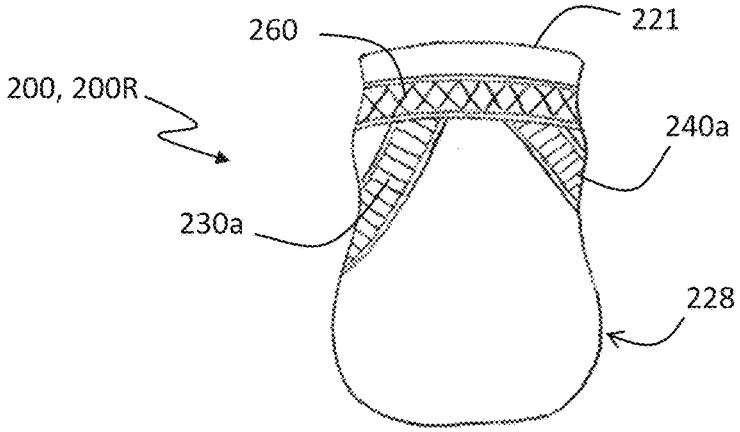
— FIG. 35 —

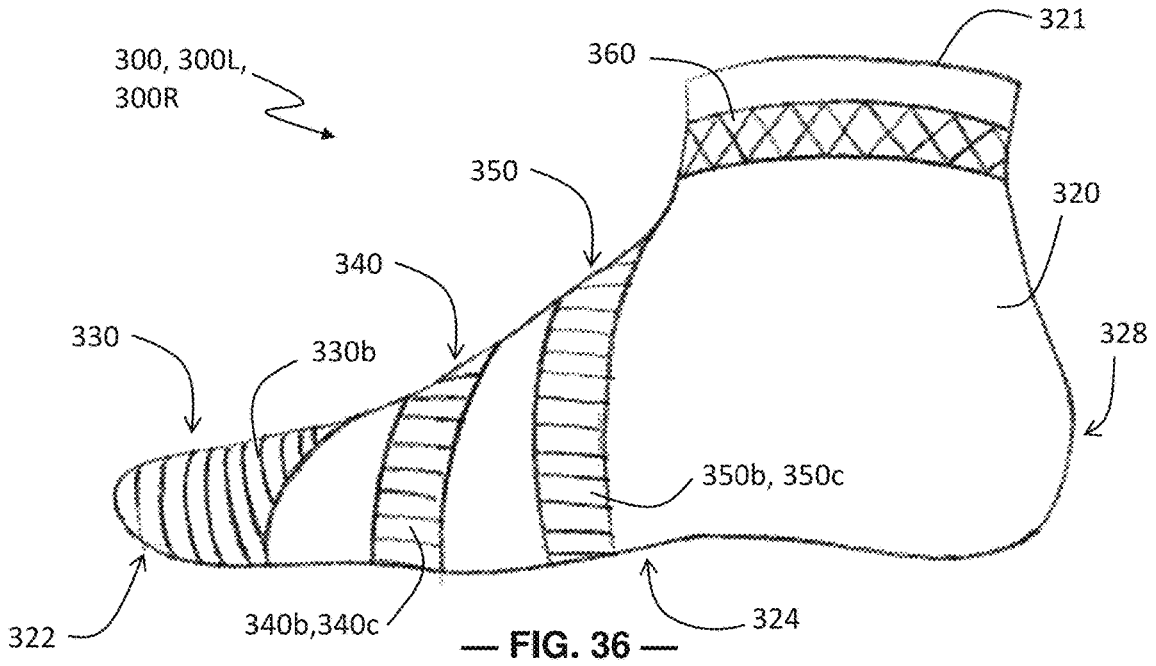
— FIG. 36 —
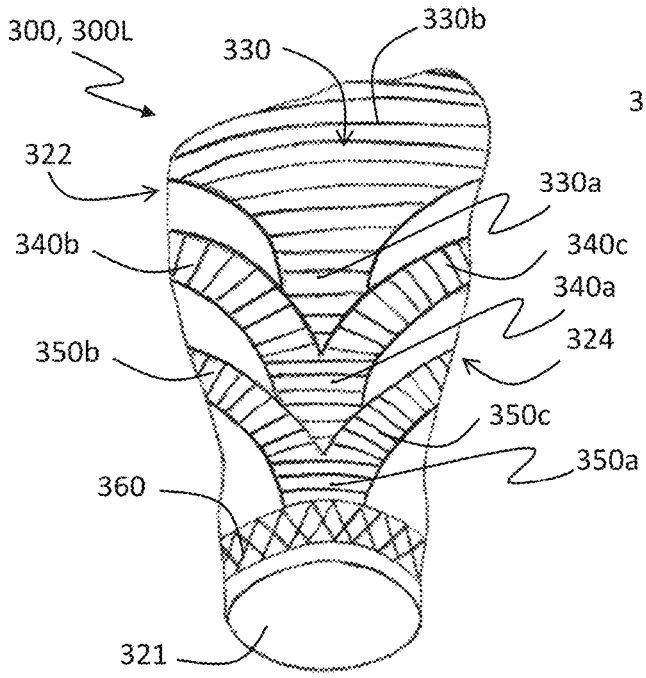
— FIG. 37 —
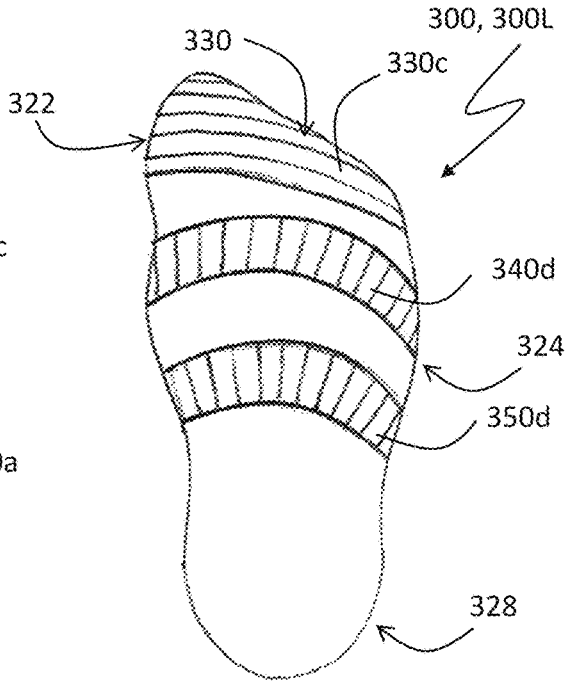
— FIG. 38 —

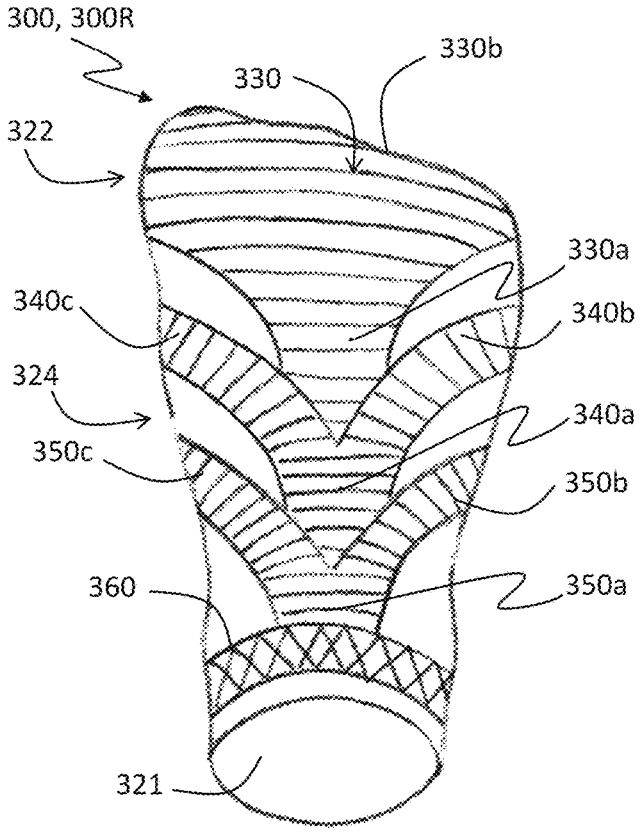
— FIG. 39 —
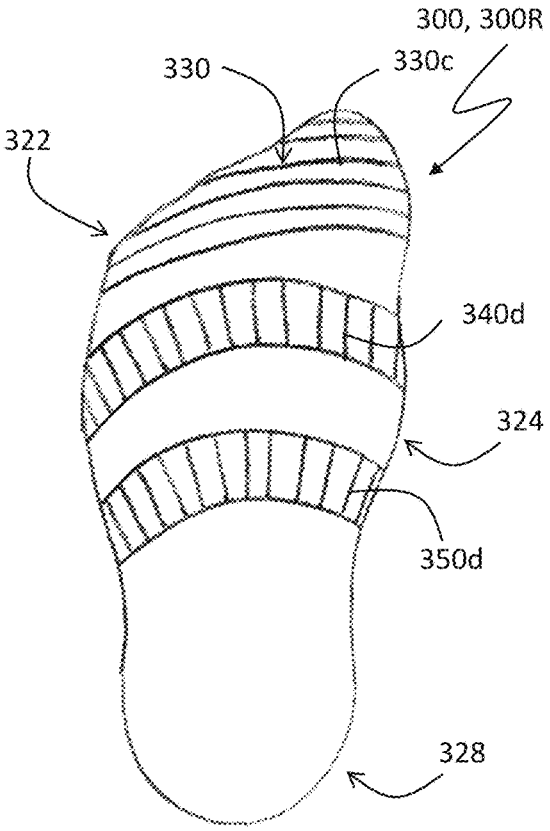
— FIG. 40 —

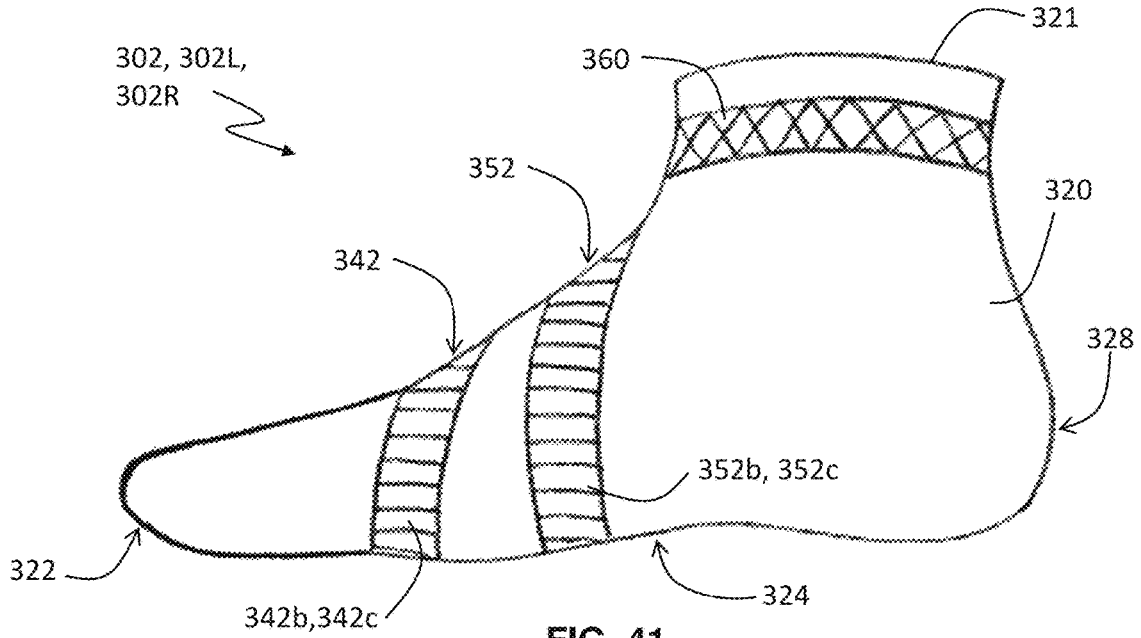
— FIG. 41 —
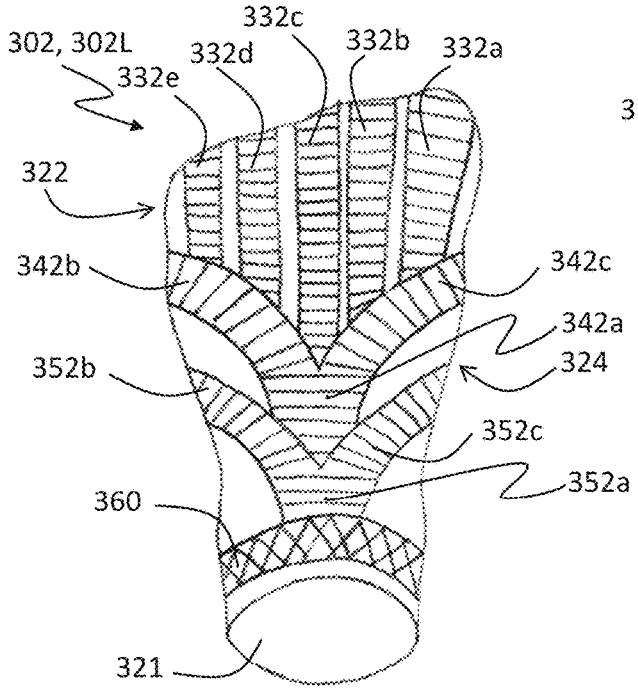
— FIG. 42 —
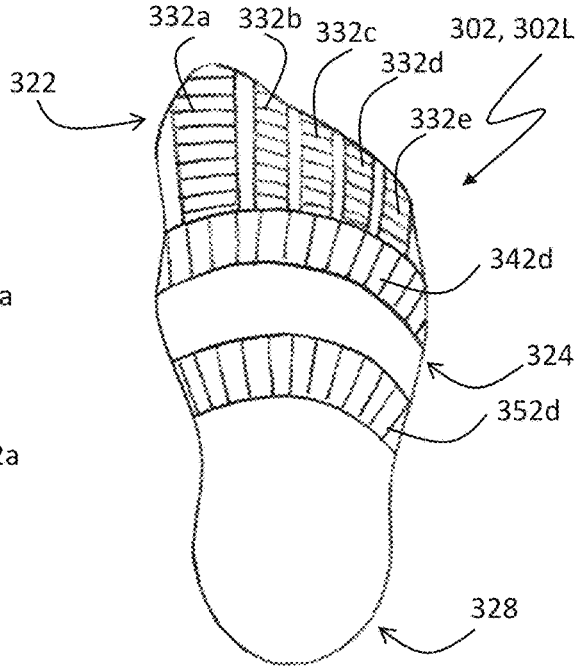
— FIG. 43 —

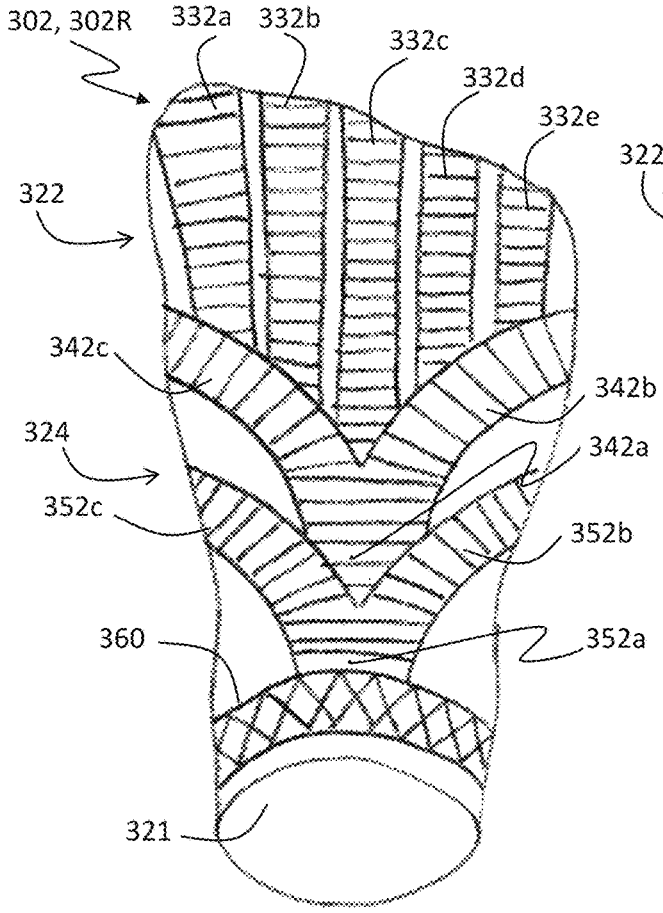
— FIG. 44 —
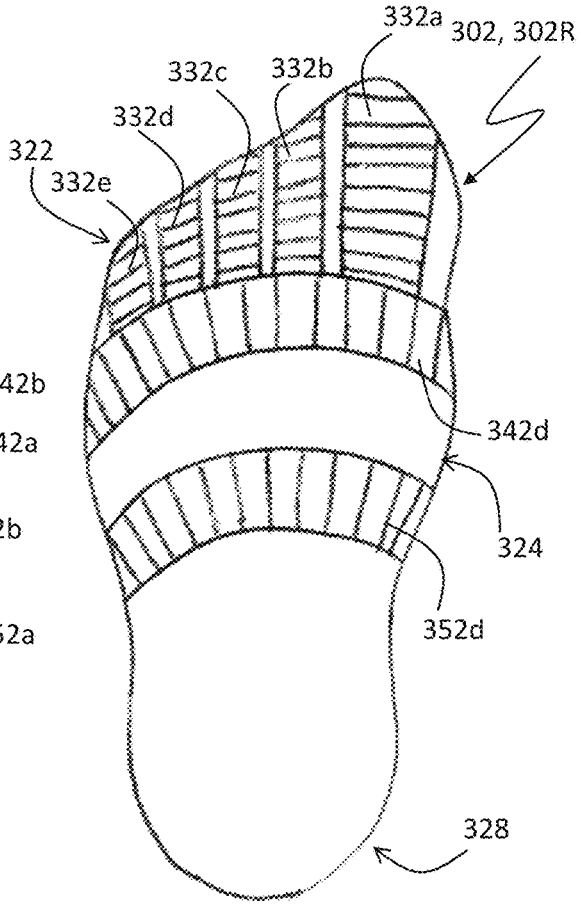
— FIG. 45 —

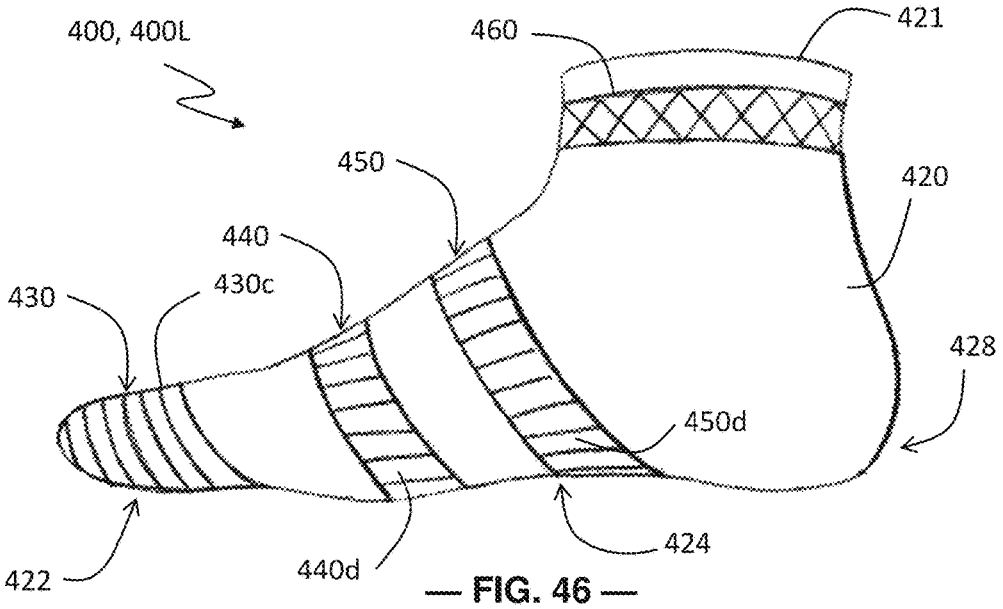
— FIG. 46 —
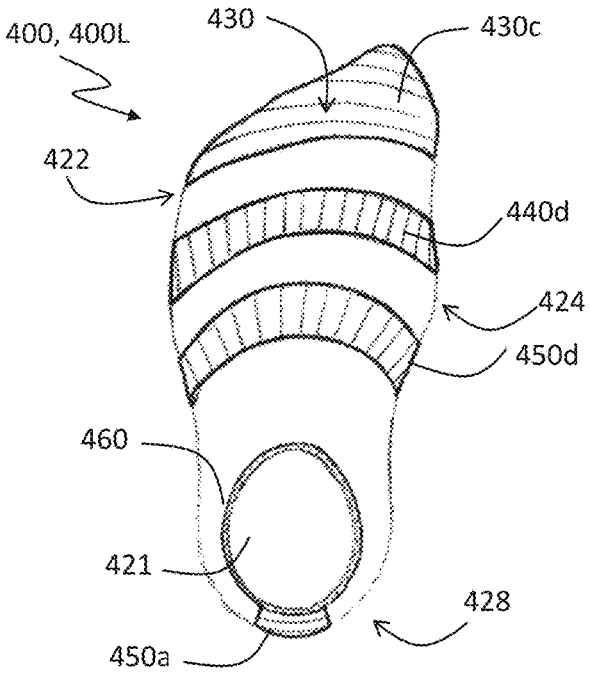
— FIG. 47 —
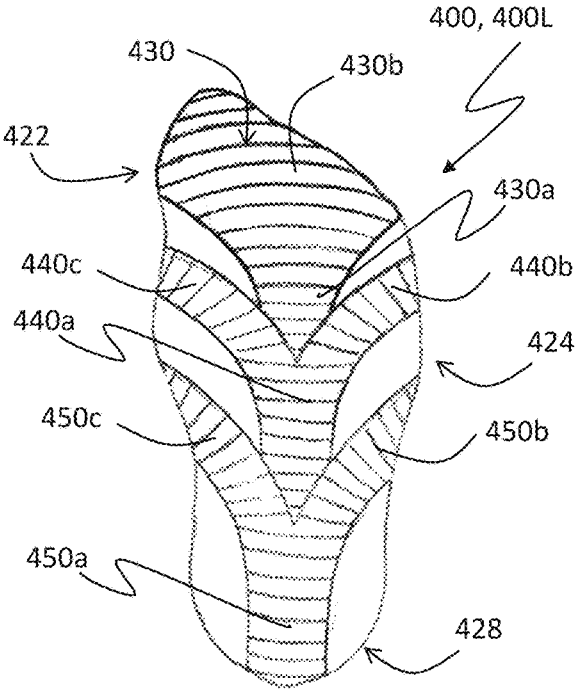
— FIG. 48 —

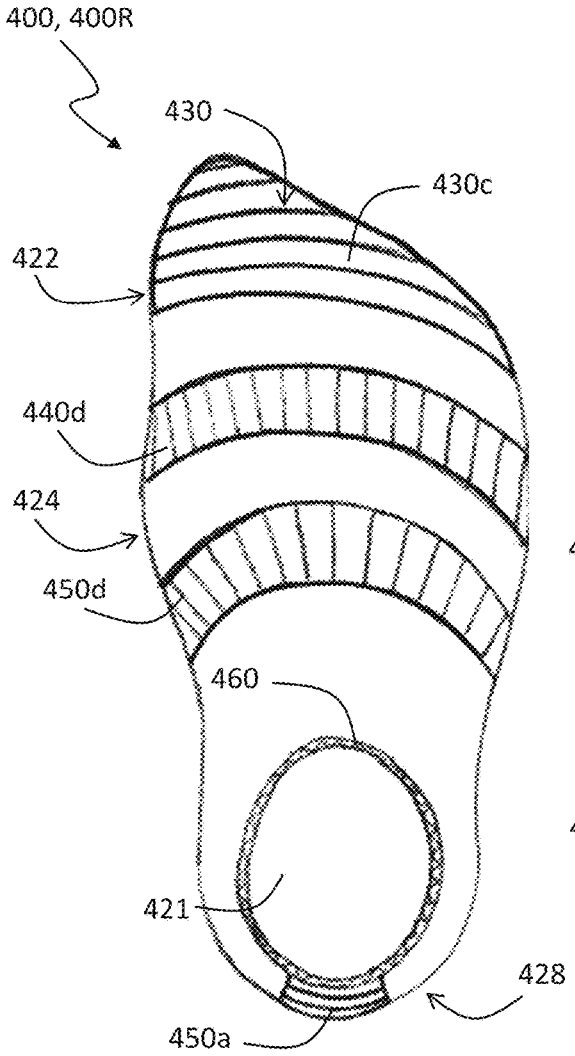
— FIG. 49 —
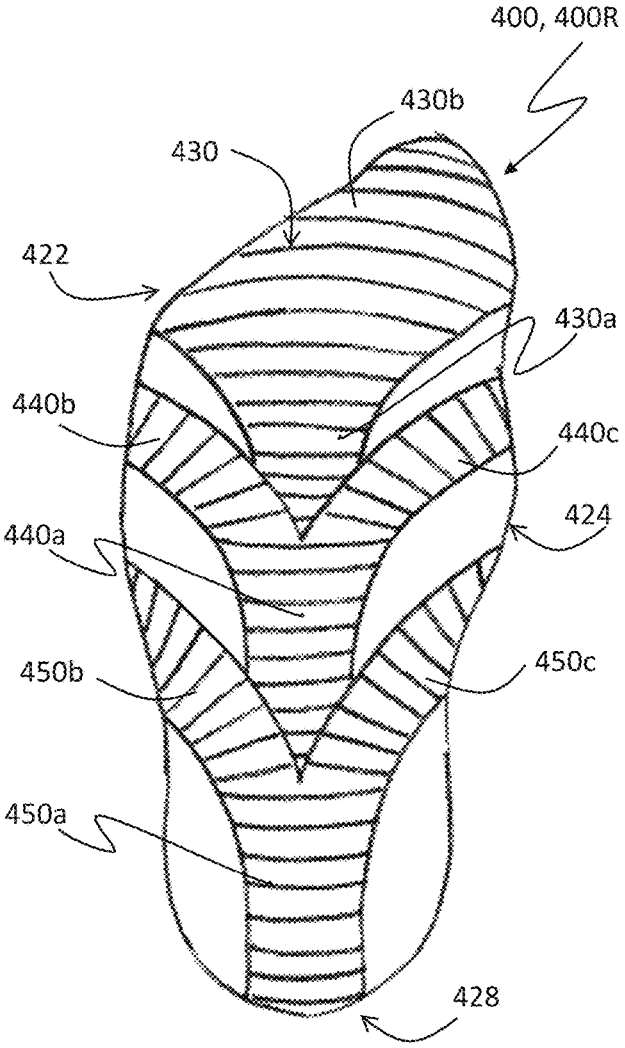
— FIG. 50 —

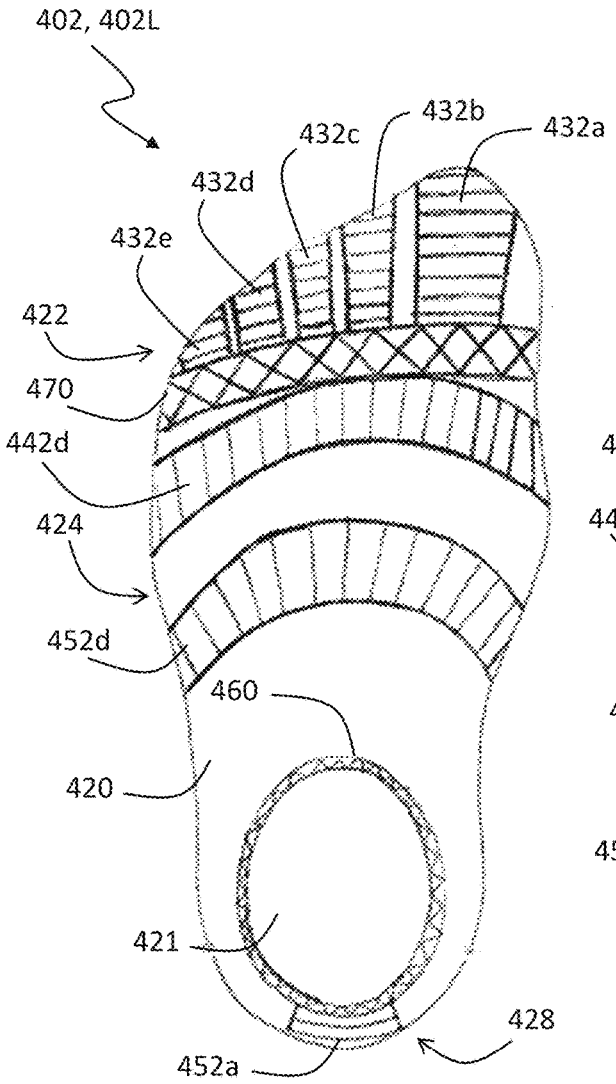
— FIG. 51 —
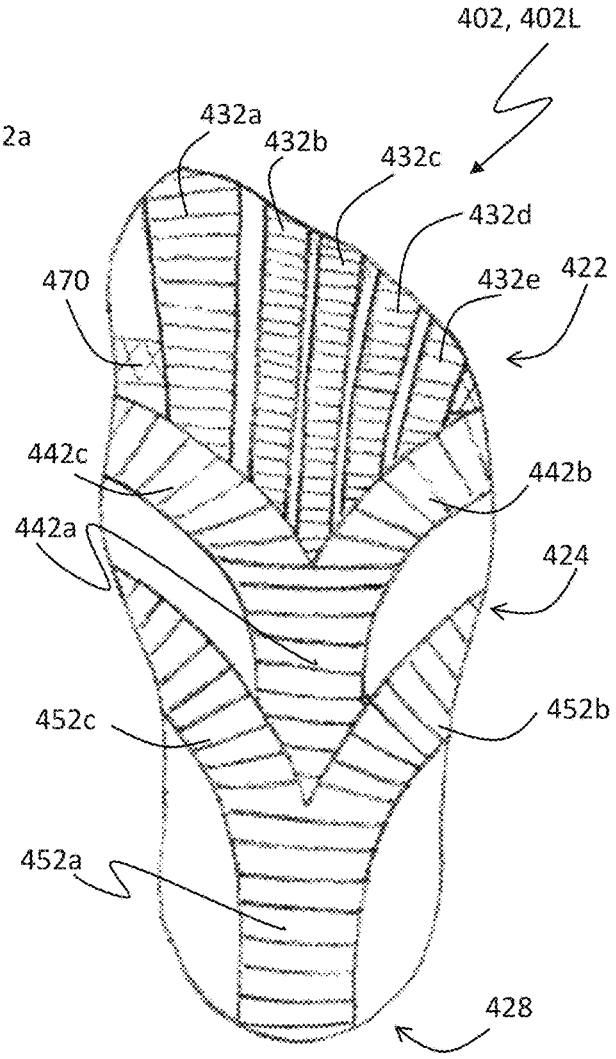
— FIG. 52 —

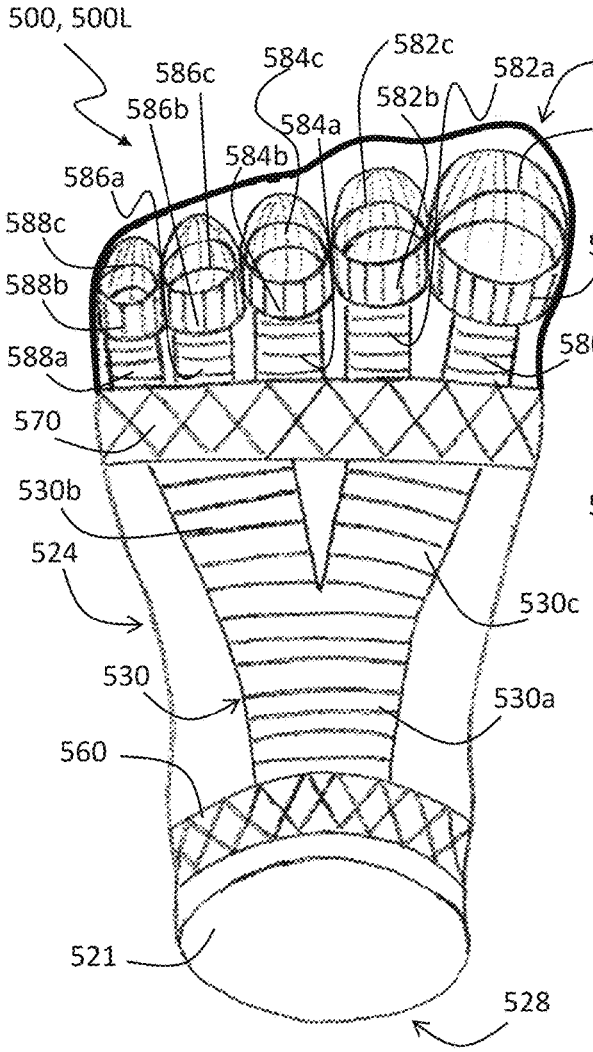
— FIG. 53 —
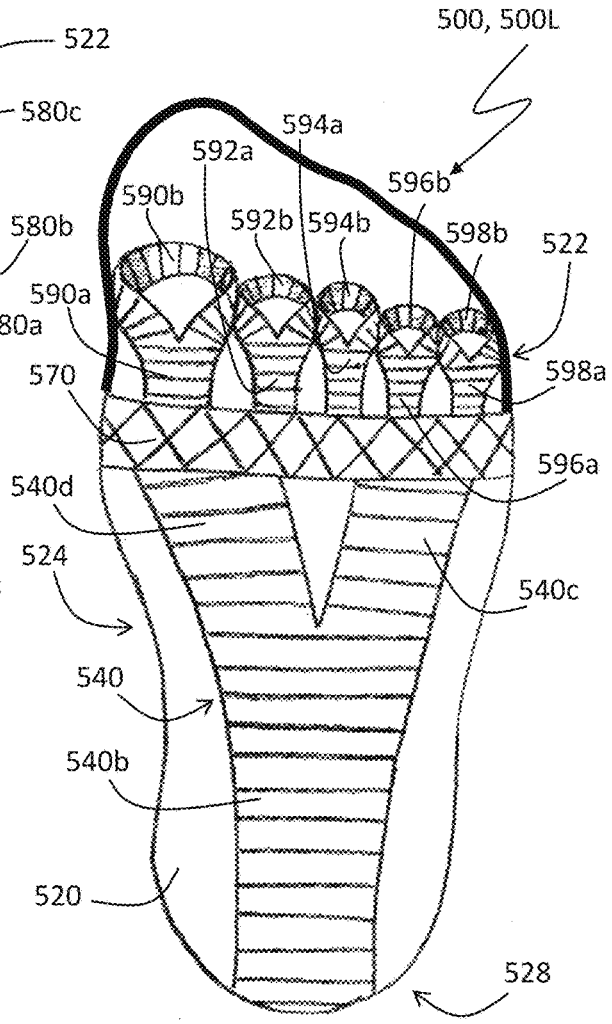
— FIG. 54 —

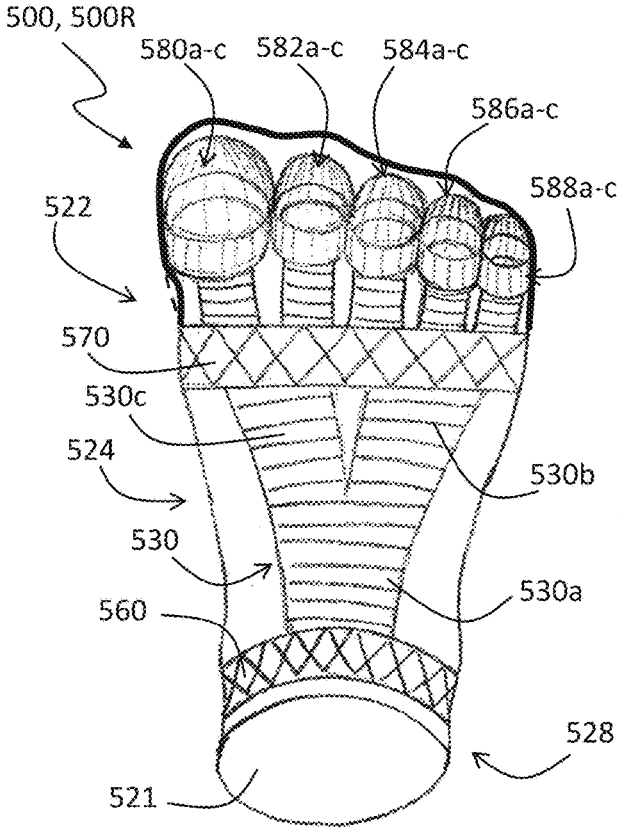
— FIG. 55 —
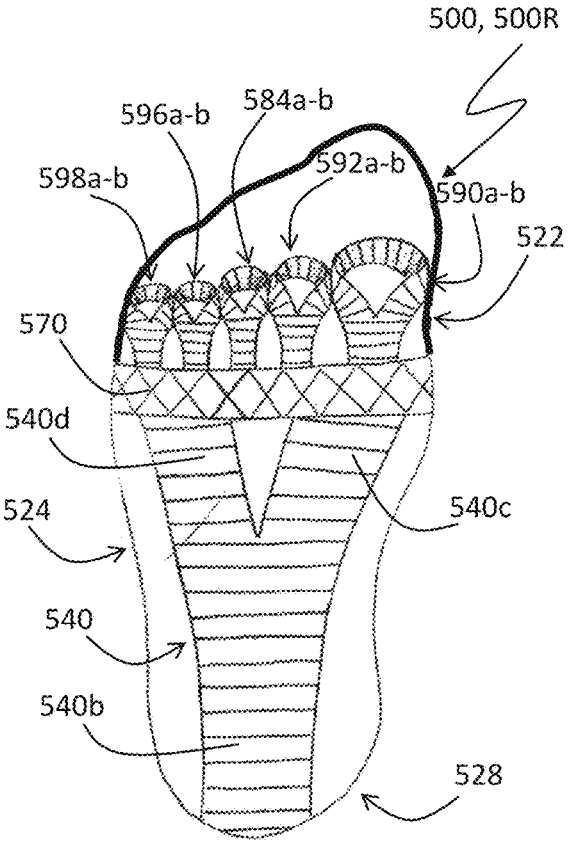
— FIG. 56 —
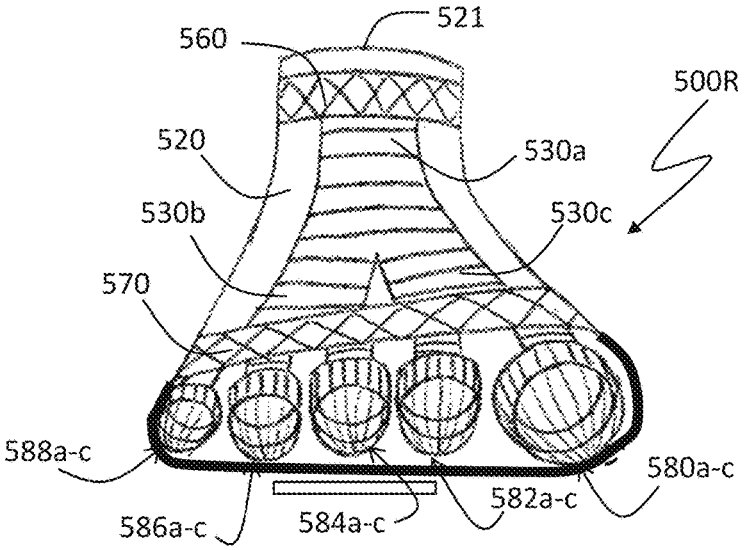
— FIG. 57 —

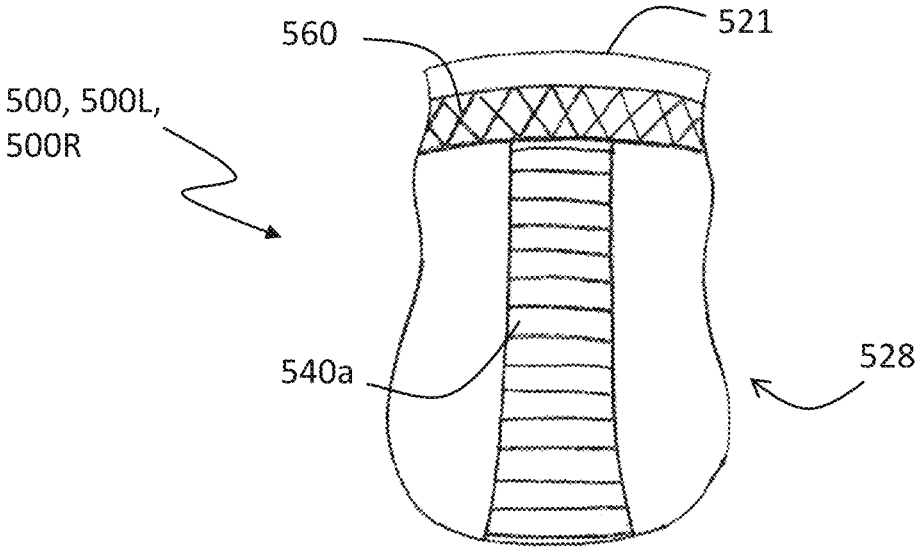
— FIG. 58 —
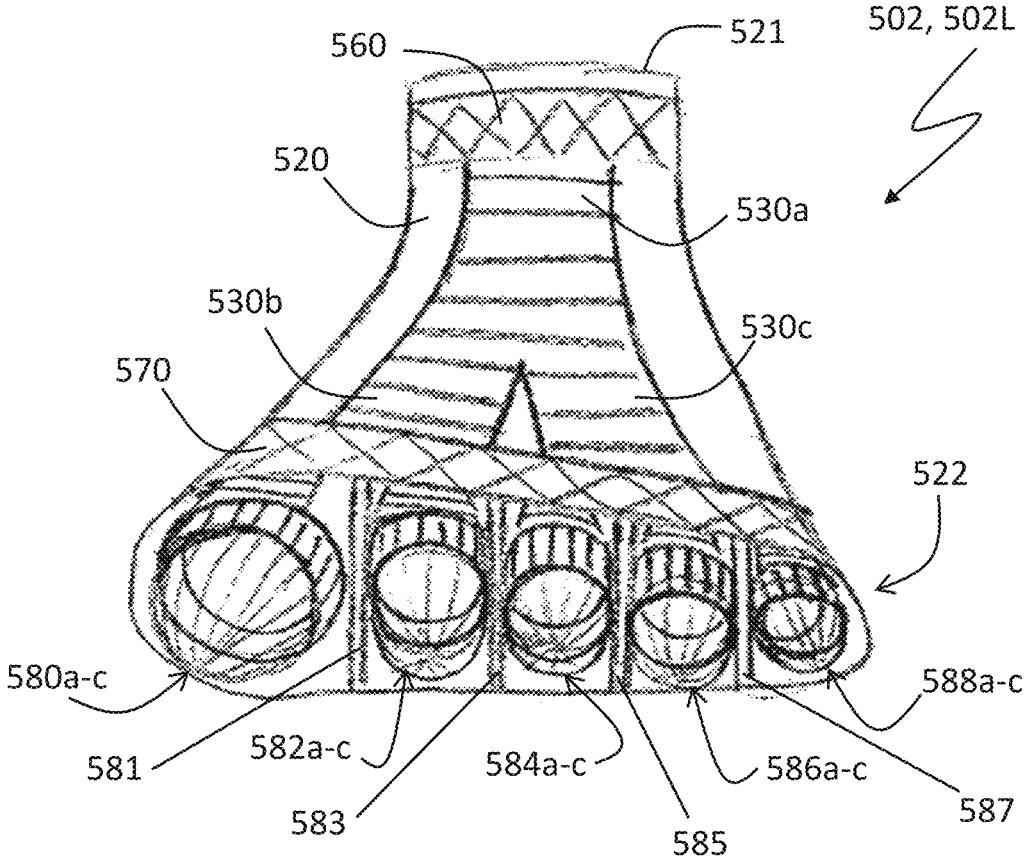
— FIG. 59 —

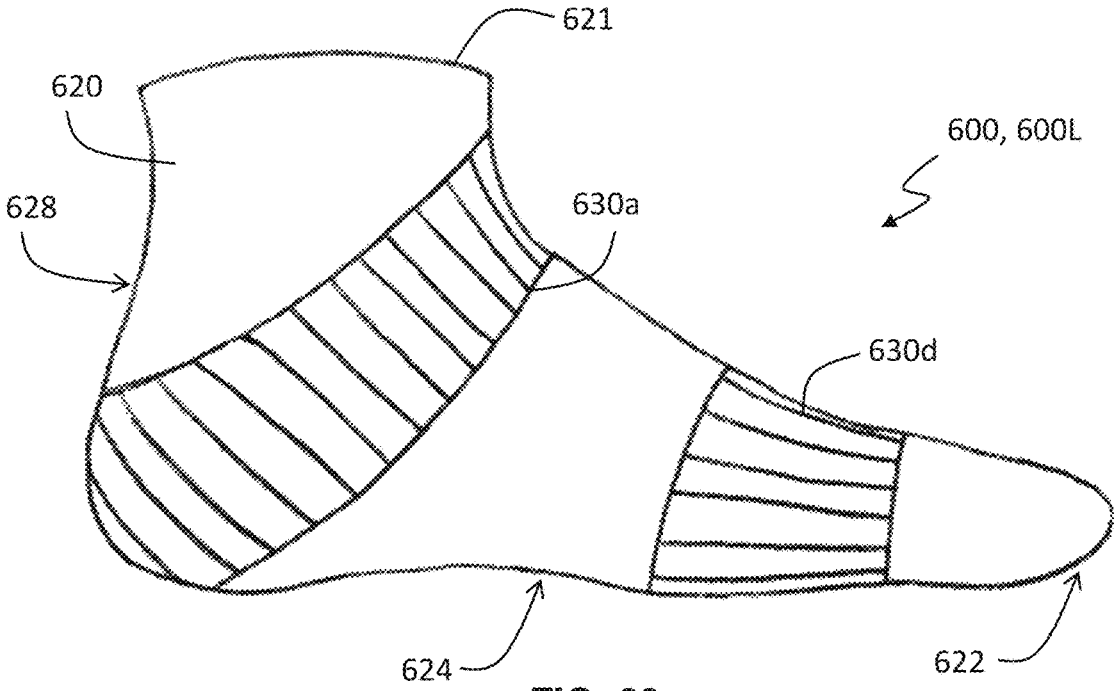
— FIG. 60 —
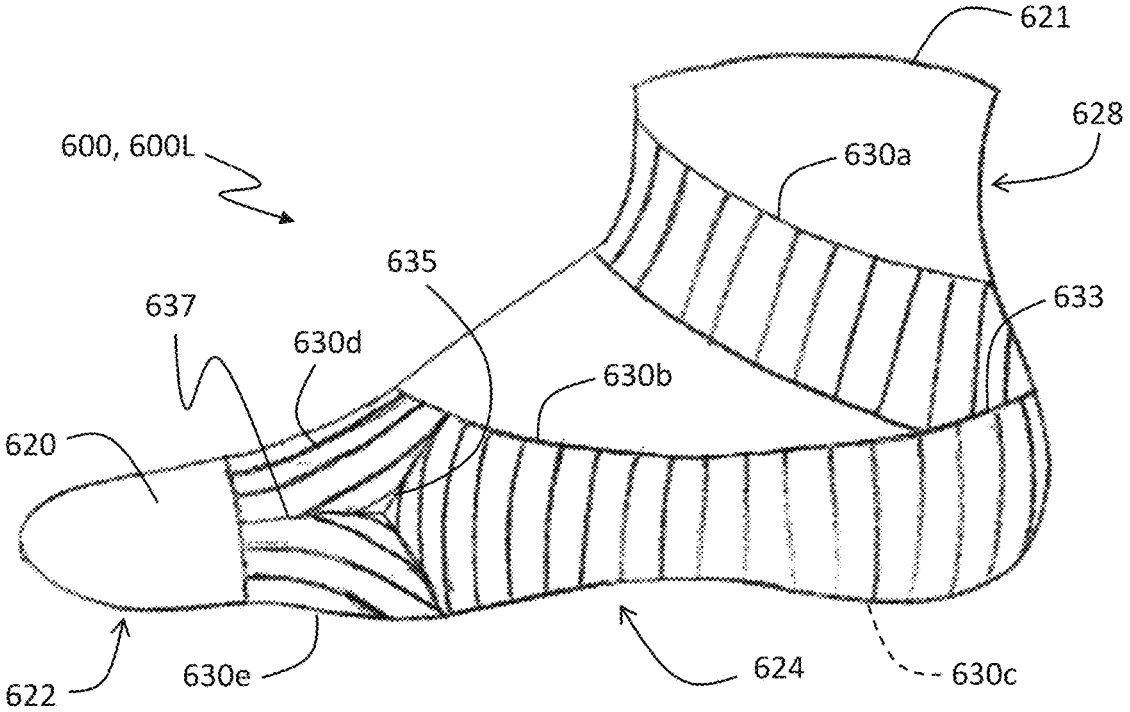
— FIG. 61 —

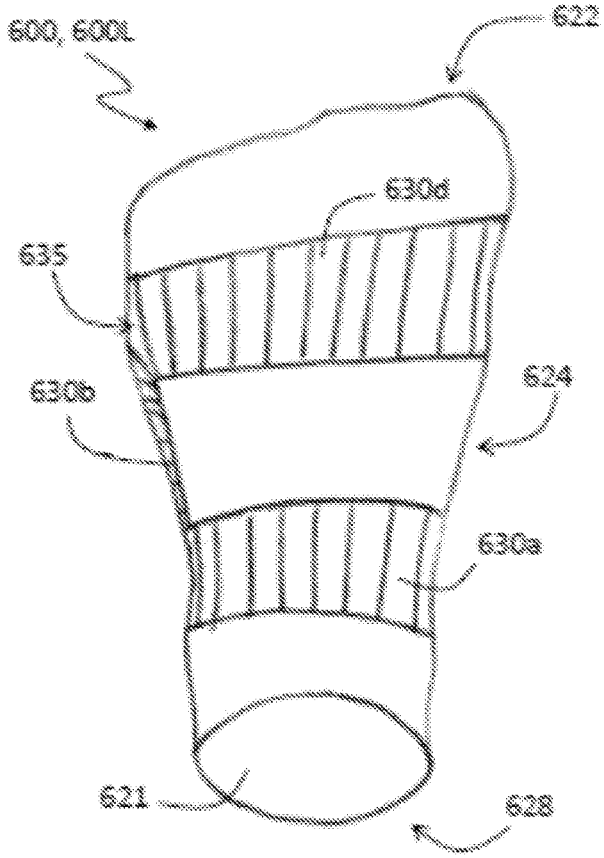
— FIG. 62 —
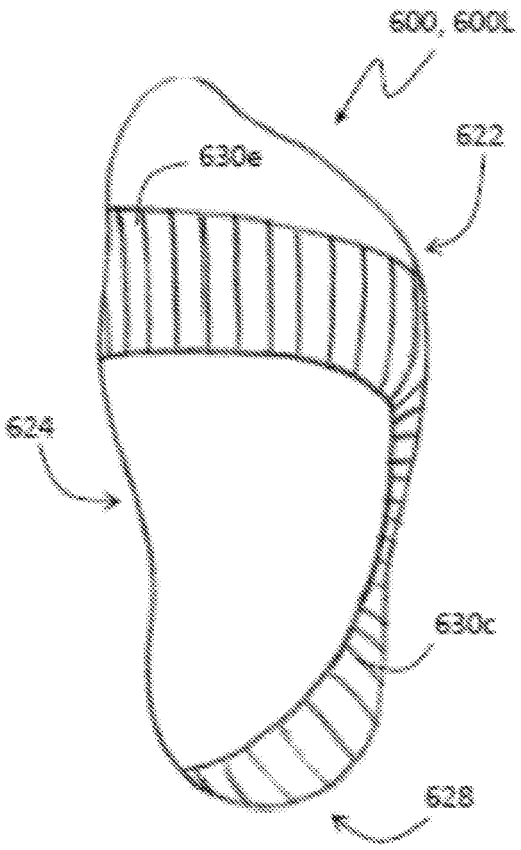
— FIG. 63 —
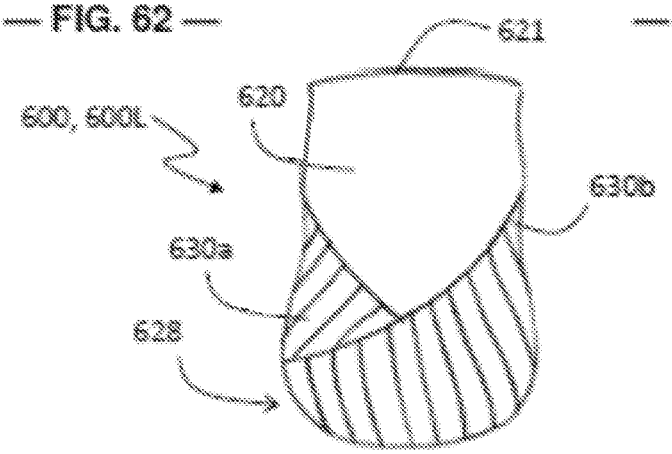
— FIG. 64 —

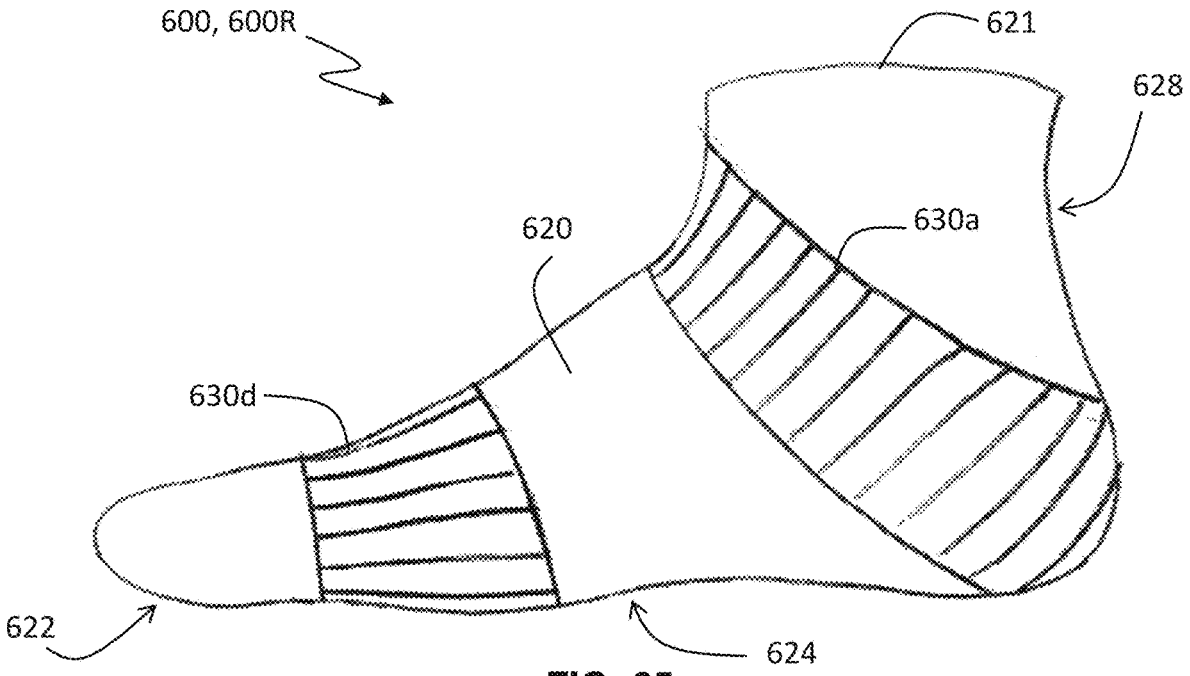
— FIG. 65 —
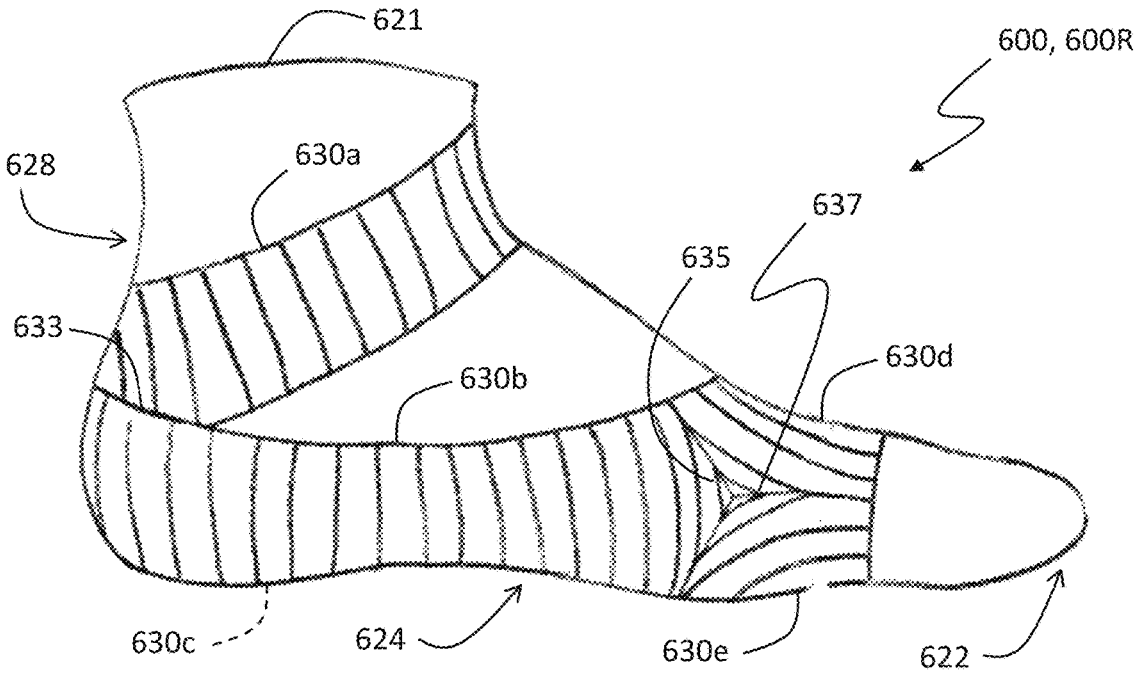
— FIG. 66 —

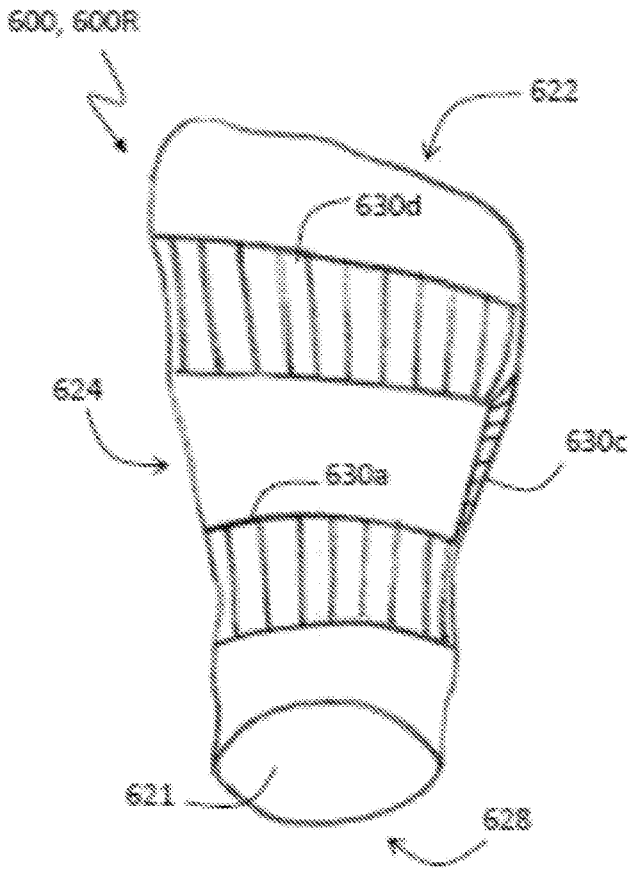
— FIG. 67 —
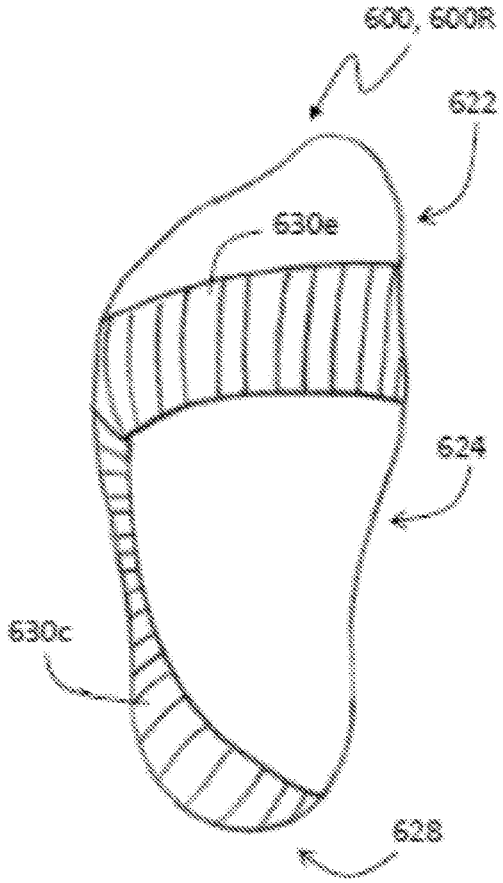
— FIG. 68 —
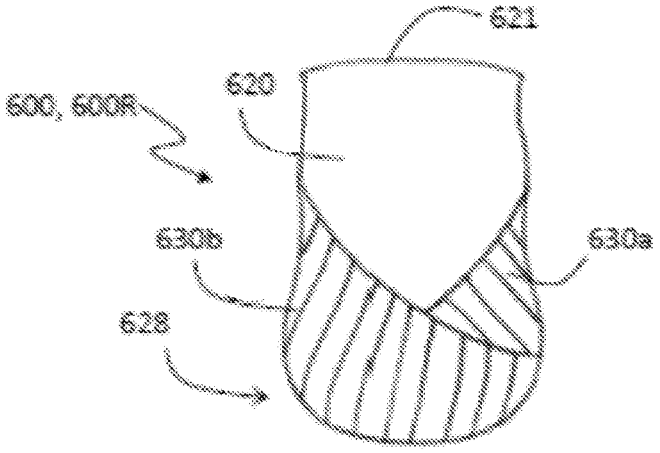
— FIG. 69 —

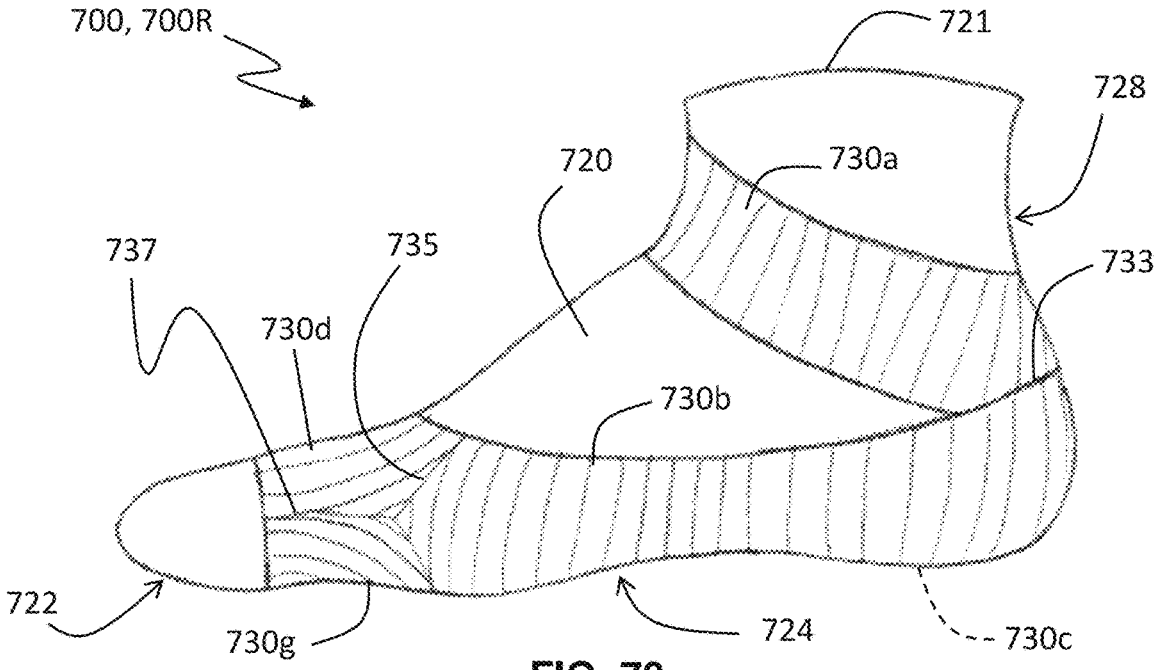
— FIG. 70 —
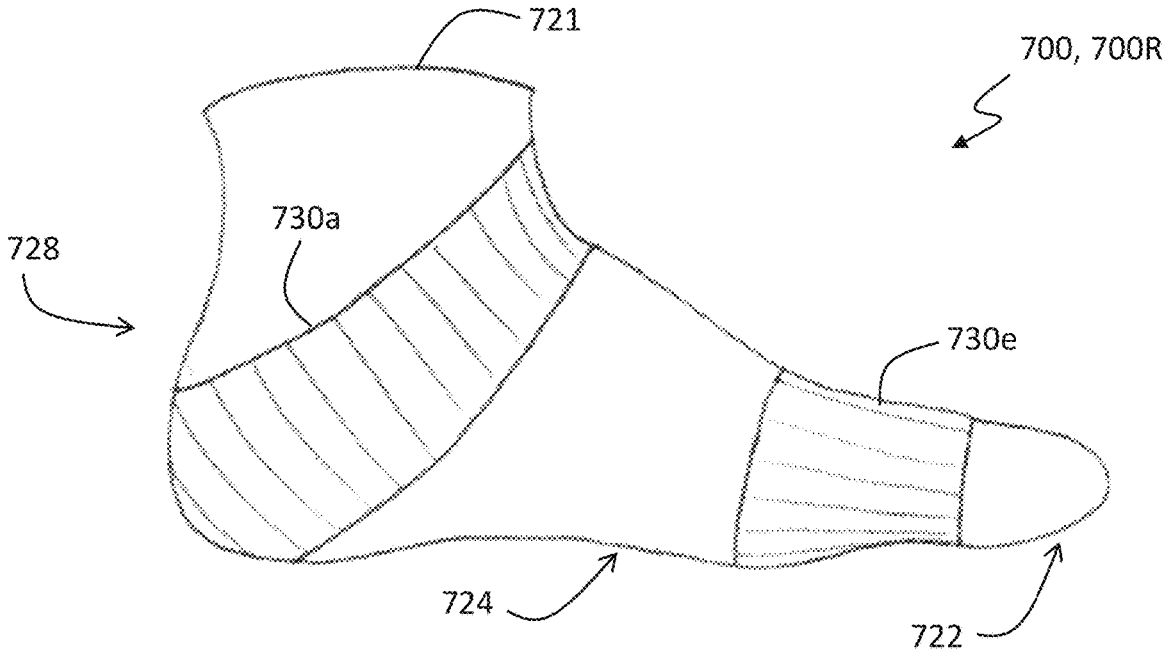
— FIG. 71 —

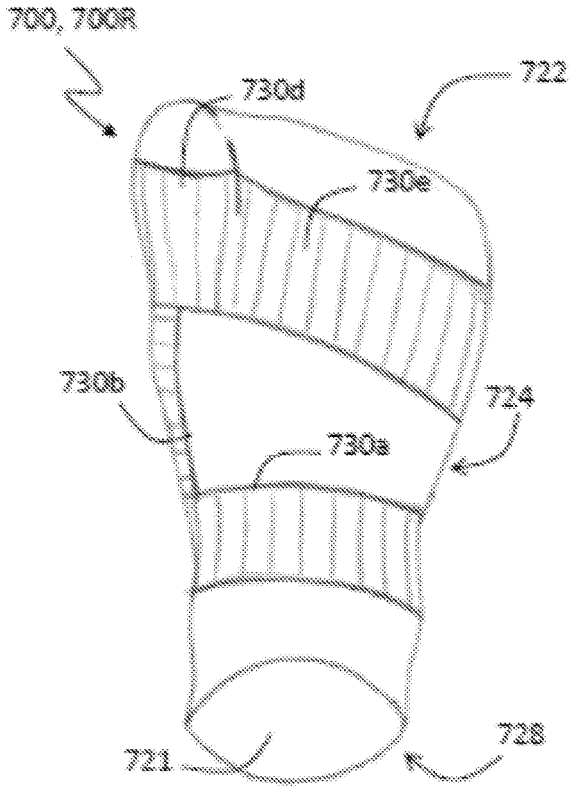
— FIG. 72 —
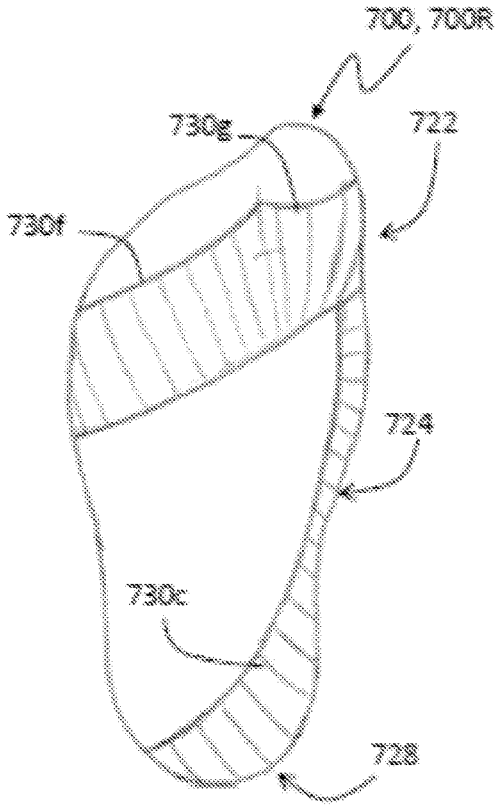
— FIG. 73 —
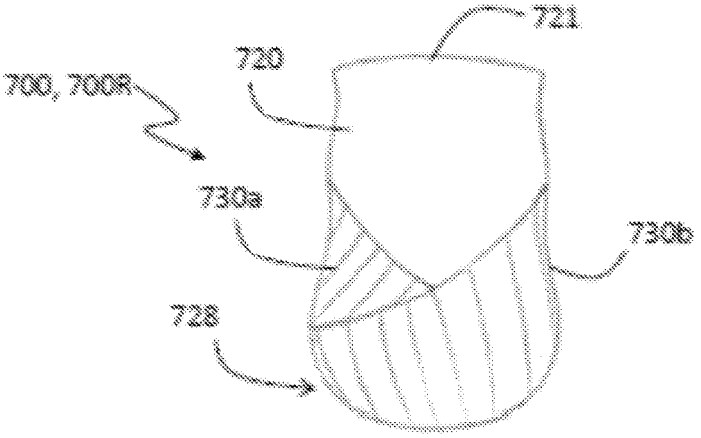
— FIG. 74 —

THERAPEUTIC SOCK WITH ONE OR MORE ELASTOMERIC BANDS

TECHNICAL FIELD

The present disclosure relates to the field of therapeutic exercise equipment and, more particularly, to a therapeutic sock that includes one or more elastomeric bands configured to permit stretching, strengthening, and supporting of targeted muscle groups of the foot.

BACKGROUND

At some point in their lives, many people experience one or more disorders of the foot that can cause pain or discomfort and can limit physical activities for the affected person. Such disorders can be caused from the over-use of one group of muscles and adjacent soft tissue, while another group of muscles and adjacent soft tissue are under-used. These activities create an imbalance with the risk of permanently impairing the natural function of the foot, leading to painful conditions that are classified as lower extremity musculoskeletal disorders.

These disorders—such as fallen or weak arches; hammertoe, claw toes, or mallet toes; ankle eversion or inversion sprains; ankle flexion or dorsiflexion limitations; and external or internal tibial torsion—may involve muscles, bones, joints, peripheral nerves, vasculature, tendons, and adjacent soft tissue. Multiple medical, occupational, governmental, and scientific organizations have studied the prevalence of these types of disorders; the financial, psychological, and mental impact of these types of disorders on the affected individuals; the societal impact of these disorders (e.g., in terms of lost productivity); and potential approaches for minimizing or remediating the stresses caused by repetitive motions and poor ergonomics.

Remediation may involve rest, icing, compression, splinting, kinesiotaping, elevation, physical therapy, surgery, and use of exercise devices. Exercise devices can be used as a reparative and/or post-surgical therapy means. However, exercises devices can also be used as a preventative therapy to strengthen muscles and to reduce stress on the ankle and adjacent soft tissue.

Unfortunately, there are no known portable devices to strengthen the muscle groups of the foot in a targeted manner to reduce the occurrence of the disorders described above. While there are a large variety of compression-type socks available on the market and while their use is appropriate for promoting blood flow to the foot, such socks fail to address the musculoskeletal foot structure that may lead to the disorders described above.

It would be useful to provide therapeutic socks that are configured for strengthening for stretching, and for supporting the muscle groups of the foot and to address the foot disorders described herein.

SUMMARY

The present therapeutic sock is configured to strengthen, stretch, and/or support a targeted muscle group of the foot. The therapeutic sock includes at least one elastomeric band located opposite the line of pull of the targeted muscle group to provide resistance. Elastomeric bands are also used to support weak muscles and to increase the proprioceptive awareness of the wearer.

Specifically, a therapeutic sock includes a textile body having a top, a bottom opposite the top, an inside side connecting the top to the bottom, an outside side opposite the inside side and connecting the top to the bottom, a heel portion, a toe portion, and an opening into which a wearer inserts his or her foot. At least one elastomeric band is disposed within the textile body and positioned to strengthen, stretch, or support one or more targeted muscle groups of the foot of the wearer. Each of the at least one elastomeric band is disposed opposite the line of pull of the one or more targeted muscle groups. In some embodiments, one or more reinforcement bands may be used in conjunction with the at least one elastomeric band.

BRIEF DESCRIPTION OF THE DRAWINGS

A full and enabling disclosure of the present products and methods, including the best mode thereof, directed to one of ordinary skill in the art, is set forth in the specification, which makes reference to the appended figures, in which:

FIG. 1 is an inside side view of a left sock, which may be used to strengthen and support an arch of a wearer's left foot, according to one aspect provided herein;

FIG. 2 is an outside side view of the left sock of FIG. 1;

FIG. 3 is a top view of the left sock of FIG. 1;

FIG. 4 is a bottom view of the left sock of FIG. 1;

FIG. 5 is an inside side view of a right sock, which may be used to strengthen and support an arch of a wearer's right foot;

FIG. 6 is an outside side of the right sock of FIG. 5;

FIG. 7 is a top view of the right sock of FIG. 5;

FIG. 8 is a bottom view of the right sock of FIG. 5;

FIG. 9 is a back view of both the left sock of FIG. 1 and the right sock of FIG. 5;

FIG. 10 is an inside side view of a left sock, which may be used to support an arch of a wearer's left foot, according to another embodiment of the present disclosure;

FIG. 11 is an outside side view of the left sock of FIG. 10;

FIG. 12 is a top view of a right sock, which may be used to support an arch of a wearer's right foot, similar to the left sock of FIG. 10;

FIG. 13 is a bottom view of the right sock of FIG. 12;

FIG. 14 is a front view of the right sock of FIG. 12;

FIG. 15 is a back view of the right sock of FIG. 12;

FIG. 16 is an inside side view of a left sock, which may be used to correct a fallen arch of a wearer's left foot and/or to strengthen the dorsiflexors of the wearer's left foot, according to another aspect provided herein;

FIG. 17 is an outside side view of the left sock of FIG. 16;

FIG. 18 is a top view of the left sock of FIG. 16;

FIG. 19 is a bottom view of the left sock of FIG. 16;

FIG. 20 is a back view of the left sock of FIG. 16;

FIG. 21 is an inside side view of a right sock, which may be used to correct a fallen arch of a wearer's right foot and/or to strengthen the dorsiflexors of the wearer's right foot;

FIG. 22 is an outside side view of the right sock of FIG. 21;

FIG. 23 is a top view of the right sock of FIG. 21;

FIG. 24 is a bottom view of the right sock of FIG. 21;

FIG. 25 is back view of the right sock of FIG. 21;

FIG. 26 is an inside side view of a left sock, which may be used to exercise ankle eversion and to correct excessive ankle inversion of the wearer's left foot, according to a further aspect provided herein;

FIG. 27 is an outside side view of the left sock of FIG. 26;

FIG. 28 is a top view of the left sock of FIG. 26;

FIG. 29 is a bottom view of the left sock of FIG. 26;

FIG. 30 is a back view of the left sock of FIG. 26;

FIG. 31 is an inside side view of a right sock, which may be used to exercise ankle eversion and to correct excessive ankle inversion of the wearer's right foot;

FIG. 32 is an outside side view of the right sock of FIG. 31;

FIG. 33 is a top view of the right sock of FIG. 31;

FIG. 34 is a bottom view of the right sock of FIG. 31;

FIG. 35 is a back view of the right sock of FIG. 31;

FIG. 36 is an inside side view of either a left sock or a right sock, which may be used to strengthen ankle flexion of a wearer's foot, according to one aspect provided herein;

FIG. 37 is a top view of a left sock in accordance with the embodiment of FIG. 36;

FIG. 38 is a bottom view of the left sock of FIGS. 36 and 37;

FIG. 39 is a top view of the right sock in accordance with the embodiment of FIG. 36;

FIG. 40 is a bottom view of the right sock of FIGS. 36 and 39;

FIG. 41 is an inside side view of either a left sock or a right sock, which may alternately be used to strengthen ankle flexion of a wearer's foot, according to another aspect provided herein;

FIG. 42 is a top view of a left sock in accordance with the embodiment of FIG. 41;

FIG. 43 is a bottom view of the left sock of FIGS. 41 and 42;

FIG. 44 is a top view of the right sock in accordance with the embodiment of FIG. 41;

FIG. 45 is a bottom view of the right sock of FIGS. 41 and 44;

FIG. 46 is an inside side view of either a left sock or a right sock, which may be used to strengthen ankle dorsiflexion of a wearer's foot, according to one aspect provided herein;

FIG. 47 is a top view of a left sock in accordance with the embodiment of FIG. 46;

FIG. 48 is a bottom view of the left sock of FIGS. 46 and 47;

FIG. 49 is a top view of a right sock in accordance with the embodiment of FIG. 46;

FIG. 50 is a bottom view of the right sock of FIGS. 46 and 49;

FIG. 51 is a top view of a left sock, which may be used to strengthen ankle dorsiflexion of a wearer's foot, as an alternative to the socks shown in FIGS. 46-50;

FIG. 52 is a bottom view of the left sock of FIG. 51;

FIG. 53 is a top view of a left sock, which may be used to correct various problems with the toes of a wearer's left foot as well as to strengthen muscles on the top and bottom of the wearer's left foot, according to another aspect provided herein;

FIG. 54 is a bottom view of the left sock of FIG. 53;

FIG. 55 is a top view of a right sock, which may be used to correct various problems with the toes of a wearer's right foot as well as to strengthen muscles on the top and bottom of the wearer's right foot, according to aspects provided herein;

FIG. 56 is a bottom view of the right sock of FIG. 55;

FIG. 57 is a front view of the right sock of FIG. 55;

FIG. 58 is a back view of both the left sock of FIG. 53 and the right sock of FIG. 55;

FIG. 59 is a front view of an alternate version of the left sock of FIG. 53;

FIG. 60 is an inside side view of a left sock, which may be used to address excessive external tibial torsion and to resist internal tibial torsion, according to a further aspect provided herein;

FIG. 61 is an outside side view of the left sock of FIG. 60;

FIG. 62 is a top view of the left sock of FIG. 60;

FIG. 63 is a bottom view of the left sock of FIG. 60;

FIG. 64 is a back view of the left sock of FIG. 60;

FIG. 65 is an inside side view of a right sock, which may be used to address excessive external tibial torsion and to resist internal tibial torsion, according to aspects provided herein;

FIG. 66 is an outside side view of the right sock of FIG. 65;

FIG. 67 is a top view of the right sock of FIG. 65;

FIG. 68 is a bottom view of the right sock of FIG. 65;

FIG. 69 is a back view of the right sock of FIG. 65;

FIG. 70 is an inside side view of a right sock, which may be used to address excessive internal tibial torsion and to resist external tibial torsion, according to aspects provided herein;

FIG. 71 is an outside side view of the right sock of FIG. 70;

FIG. 72 is a front view of the right sock of FIG. 70;

FIG. 73 is a bottom view of the right sock of FIG. 70; and

FIG. 74 is a back view of the right sock of FIG. 70.

DETAILED DESCRIPTION

Reference will now be made in detail to the presently preferred embodiments of therapeutic socks, one or more examples of which are illustrated in the figures. Each example is provided by way of explanation and is not meant to be a limitation of the claimed subject matter. For example, features illustrated or described as part of one embodiment may be used with a different embodiment to yield yet still another embodiment. It is intended that the present application include such modifications and variations as come within the scope and spirit of the present disclosure. Selected combinations or aspects of the disclosed technology correspond to a plurality of different embodiments of the present alert notification system. Certain features may be interchanged with similar devices or different features not expressly mentioned that perform the same or similar functions.

As used herein, the singular forms of "a," "and," and "the" include plural versions, unless the context clearly dictates otherwise.

To facilitate discussion of the present therapeutic socks, it will be necessary to refer to various terminology. Each sock includes a textile body (such as a knitted fabric) having a toe portion, a mid-foot portion (which is aligned with the arch of the foot), a heel portion, and an ankle portion (which is adjacent to or covers a portion of the ankle). While the Figures provided herein illustrate a low-cut or ankle-height sock, it should be understood that other sock lengths, such as crew, mid-calf, or knee-high, may instead be used. Thus, there may be an additional length of the sock beyond the sock opening illustrated in the Figures.

The term "inside side" of the foot or sock refers to the side of the foot or sock with the innermost (big) toe (i.e., the hallux), while the term "outside side" refers to the side of the foot or sock with the outermost (little) toe. When a person is standing or sitting without his legs crossed, the inside side of the left foot is adjacent to the inside side of the right foot. The "bottom" (or "sole") of a sock is the side that normally covers the sole of the wearer's foot and that is normally in contact with the floor or the interior bottom surface of the wearer's shoe. The "top" of a sock is the side opposite the bottom of the sock.

The present therapeutic socks strengthen and/or stretch one or more weak muscle groups in the wearer's foot and/or support the muscle groups in the correct position. Each sock includes at least one elastomeric band that is incorporated in the body of the sock and that is positioned against the line of pull of the muscle groups to be strengthened and with the line of pull of the muscle groups to be supported. The elastomeric band may be knitted or woven separately from the body of the sock and joined to the body during or after construction, or the elastomeric band may be made in situ with the body of the sock by weaving or knitting elastomeric yarns into the body, where appropriate. The elastomeric band can exercise the muscle groups by providing resistance when the wearer moves his/her foot in a prescribed manner or influences muscle length tension when the elastomeric band(s) of the sock supports a weak muscle or muscle group. In some embodiments, a reinforcement strip is used in conjunction with the elastomeric band(s).

The present therapeutic socks may be used for people of any age and, therefore, may be sized to fit a variety of foot sizes. Each sock may include markings, such as internal (knitted-in) or external (attached) labels, colors, or other indicia, which indicate the purpose of the sock and/or the foot on which a particular sock should be worn for optimal benefit.

According to a first embodiment, FIGS. 1 through 9 illustrate various views of socks for the left foot and the right foot of a wearer, which may be used to strengthen the arches of the wearer's feet by activating the arch muscles, which support and lift the arch when the wearer moves his lower leg, ankle, and foot in a prescribed manner. FIGS. 1 through 4 respectively illustrate the inside side view, the outside side view, the top view, and the bottom view of the left sock 10L, while FIGS. 5 through 8 illustrate similar views of the right sock 10R. FIG. 9 illustrates the back view of both the left sock and the right sock.

As shown in FIGS. 1 through 9, a sock 10 has a body 20 made of a textile material (e.g., a knitted fabric) that surrounds the wearer's foot. The body 20 has an opening 21 through which the wearer inserts his/her foot (FIGS. 3 and 7). A first elastomeric band 30 extends around a mid-foot portion 24 of each sock 10 (as shown in FIGS. 1, 2, 5, and 6). That is, the first elastomeric band 30 extends from the top of the sock 10 (as shown in FIGS. 3 and 7), continues under the mid-foot portion 24 (as shown in FIGS. 4 and 8), and returns to the top of the sock 10 where it connects to itself and/or to a second elastomeric band 40.

The second elastomeric band 40 forms a "figure-8" shape around the wearer's heel and the wearer's big toe. Specifically, the second elastomeric band 40 has a first section 40*a* that extends from a heel portion 28 of the sock 10 (as shown in FIG. 9) on the inside side of the sock 10 and over the top of the sock 10 (as shown in FIGS. 1 and 5). A second section 40*b*, contiguous with the first section 40*a*, extends from the mid-foot portion 24 to the toe portion 22, where the second elastomeric band 40 is positioned between the big toe and the second toe (shown in FIGS. 3 and 7). A third section 40*c* (shown in FIGS. 4 and 8) wraps around the big toe from the top of the sock 10 across the bottom, or sole, of the sock 10.

After circumscribing the big toe, a fourth section 40*d* of the second elastomeric band 40 returns to the top of the sock 10 on the inside side of the sock 10 (shown in FIGS. 3 and 7) and extends over the second portion 40*b* and the first elastomeric band 30 as the fourth section 40*d* crosses to the outside side of the sock 10 near the heel portion 28 (shown in FIGS. 2 and 6). A fifth section 40*e* (shown in FIG. 9) wraps around the heel portion 28 and connects the first section 40*a* and the fourth section 40*d*. Although the second elastomeric band 40 is described as having various sections (40*a* through 40*e*), it should be understood that such description is used for explaining the arrangement of the second elastomeric band 40 and that the second elastomeric band 40 is a single continuous elastomeric band. It should be noted that the second elastomeric band 40 remains flat within the body 20 of the sock 10 without any twists in the second elastomeric band 40. A thickness of second elastomeric band 40 on the top of textile body 20 is defined by a combination of the thickness of textile body 20, the thickness of the first elastomeric band 30, a thickness of a lower layer 40*d* of second elastomeric band 40 that overlaps first elastomeric band 30, and a thickness of an upper layer 40*b* of second elastomeric band 40 that overlaps the lower layer 40*d* of second elastomeric band 40.

The combination of the first elastomeric band 30 and the second elastomeric band 40 provide resistance against, and support for, the muscles in the arch and mid-foot portion of the wearer's foot and the calf of the wearer's leg. This resistance strengthens the arch, which may reduce the wearer's foot pain and increase proprioceptive awareness. Specifically, the first elastomeric band 30 and the second elastomeric band 40 can exercise or strengthen the plantar aponeurosis muscles of the sole of the foot and the tibialis anterior, tibialis posterior, flexor digitorum, flexor digitorum brevis, flexor hallucis longus, abductor hallucis, abductor digiti minimi, fibularis longus, fibularis brevis, and fibularis tertius muscles, and can reduce stress on the ligaments of all the involved articulations.

According to a second embodiment, FIGS. 10 through 15 illustrate various views of socks 12 for the left foot and the right foot of a wearer, which may alternately be used to support the arches of the wearer's feet by rotating the calcaneus bone medially and lifting the navicular bone, the first cuneiform bones, and the proximal aspect of the first metatarsal while the sock 12 is worn. FIGS. 10 and 11 illustrate the inside side view and the outside side view of the left sock 12L, while FIGS. 12, 13, and 14 illustrate the top view, bottom view, and front view of the right sock 12R, respectively. FIG. 15 illustrates the back (heel) view of the right sock 12R.

Like the sock 10 of FIGS. 1 through 9, the sock 12 of FIGS. 10 through 15 has a body 20 made of a textile material (e.g., a knitted fabric) with an opening 21 through which the wearer inserts his/her foot and a first elastomeric band 30 that wraps around the body 20 of the sock 12 and overlaps itself on both the top of the sock 12 (as shown in FIG. 12) and the bottom of the sock 12 (as shown in FIG. 13).

In the left sock 12L, starting at the heel portion 28 of the sock 12 (shown in FIG. 15), a first section 30*a* of the elastomeric band 30 (shown in FIG. 11) extends from the heel portion 28 and wraps across the inside side of the sock 12 and under the bottom of the sock 12. A second section 30*b* of the elastomeric band 30 continues from the first section 50*a* across the bottom of the sock 12 and wraps from the outside side of the sock 12L to the inside side of the sock 12L (shown in FIG. 13). The second section 30*b* connects to a third section 30*c*, which is spaced apart from the first section 30*a* in a bifurcated arrangement on the outside side of the sock 12L (shown in FIG. 10). The first section 30*a* and the third section 30*c* come together to form a fourth section 30*d* at the top of the sock 12L. As shown in FIG. 12, the fourth section 30*d* of the elastomeric band 30 extends from the first section 30*a* and the third section 30*c* at the mid-foot portion 24 of the sock and wraps across the top of the sock 12L toward the outside side of the sock 12L.

The fourth section 30*d* wraps under the sock 12L at the outside side of the sock 12 and continues as a fifth section 30*e* that extends across the mid-portion 24 of the bottom of the sock 12L (shown in FIG. 13). A sixth section 30*f* continues from the fifth section 30*e* and wraps across the top of the sock 12 from the inside side of the sock 12L toward the outside side of the sock 12L (shown in FIG. 12). The sixth section 30*f* wraps under the outside side of the sock 12L and becomes a seventh section 30*g* that overlaps the fifth section 30*e* at a junction 33 on the bottom of the sock 12L (shown in FIG. 13). The seventh section 30*g* extends across the toe portion 22 on the bottom of the sock 12L from the inside side of the sock 12L toward the outside side of the sock 12L.

As shown in FIG. 12, the seventh section 30*g* extends onto the top of the sock 12L at the inside side of the sock 12L near the toe portion 22 and becomes the eighth section 30*h*, which overlaps the sixth portion 30*f* at a junction 35. The eighth section 30*h* extends across the top of the sock 12L from the junction 35 and overlaps the fourth portion 30*d* at a junction 37 as the eighth section 30*h* continues toward the outside side of the sock 12L toward the heel portion 28 (shown also in FIG. 14). The eighth section 30*h* becomes the ninth section 30*i* near the opening 21 on the inside side of the sock 12L and connects to a portion of the first section 30*a* at the heel portion 28 (shown in FIG. 15).

As before, the elastomeric band 30 includes continuous sections 30*a* through 30*i*, which are labeled merely to facilitate discussion of the respective positions of the sections along the elastomeric band 30. It should be noted that the elastomeric band 30 remains flat within the body 20 of the sock 12 without any twists in the second elastomeric band 30, although the widths of various sections of the elastomeric band 30 vary along its length.

The positioning of the elastomeric band 30 in the right sock 12R is opposite that of the left sock 12L.

The first elastomeric band 30 provides support to the arch of the wearer's foot. The band 30 pulls the calcaneus bone medially and lifts the navicular bone, first cuneiform bone, and the proximal aspect of the first metatarsal bone, in turn lifting the arch and reducing the stress on the weakened muscles that allowed the arch to collapse.

FIGS. 16 through 25 illustrate various views of socks for the left foot and the right foot of a wearer, which may be used to correct fallen arches of the wearer's feet and to strengthen the posterior tibialis and the extensor digitorum longus and extensor digitorum brevis muscles by activating the target muscle groups. FIGS. 16 through 20 respectively illustrate the inside side view, the outside side view, the top view, the bottom view, and the back view of the left sock 100L, while FIGS. 21 through 25 illustrate similar views of the right sock 100R.

A fallen arch occurs when the foot loses its gently curving arch on the inner side of the sole, just in front of the heel. A person with fallen arches (also known as flat feet) can experience a tendency for the toes to point outward as he walks, a condition called out-toeing. People with fallen arches often complain of tired, aching feet, especially after extended periods of standing or walking.

As shown in FIGS. 16 through 25, a sock 100 has a body 120 made of a knitted material that surrounds the wearer's foot. The foot is inserted through an opening 121 that defines a terminal end of the sock 100, which is proximate to the wearer's ankle in this exemplary embodiment. On the inside side of the sock 100 (as shown in FIGS. 16 and 21), a first section 130*a* of a first elastomeric band 130 extends from a heel portion 128 and under a mid-foot portion 124 of each sock 100 (shown in FIGS. 16 and 21). A second section 130*b* of the first elastomeric band 130 (shown in FIGS. 19 and 24) extends across the bottom of the sock 100 from the mid-foot portion 124 to between the big toe and the second toe at the toe portion 122. A third section 130*c* of the first elastomeric band 130 extends across the top of the sock 100 from between the big toe and the second toe at the toe portion 122 toward the outside side of the sock 100 at the heel portion 128 (shown in FIGS. 18 and 23). A fourth section 130*d* of the first elastomeric band 130 wraps around the heel portion 128 and connects to the first section 130*a* (shown in FIGS. 20 and 25). As illustrated, the fourth section 130*d* of the first elastomeric band 130 is positioned at an angle from the inside side of the sock 100 to the outside side of the sock 100.

The sections 130*a* through 130*d* are continuous and integral with one another in the first elastomeric band 130. It should be noted that the first elastomeric band 130 remains flat within the body 120 of the sock 100 but may narrow in the space around the big toe.

The sock 100 also includes a second elastomeric band 140. As shown in FIGS. 19 and 23, the second elastomeric band 140 encloses a majority of the toe portion 122 of the sock 100 on the top side of the sock 100. The second elastomeric band 140 does not enclose the big toe. As shown in FIGS. 20 and 24, the second elastomeric band 140 fully wraps around the toe portion 122 (excluding the big toe) and narrows in width to its distal end 142, where the second elastomeric band 140 connects to the first elastomeric band 130 on the bottom of the sock 100 near the mid-foot portion 124.

While the wearer plants the big toe, forefoot, and heel on the ground and then pivots the knee and ankle outward, the first elastomeric band 130 provides resistance against the heel portion 128 and ankle portion of the wearer's foot (raising the arch) and provides resistance against the arch at the mid-foot portion 124. The second elastomeric band 140 provides a physical cue to the wearer to keep his or her toes flat against the ground and can be used to strengthen the dorsiflexors of the foot and ankle. The combination of localized resistance lifts the wearer's arch and strengthens the posterior tibia muscle, thereby reducing discomfort to the wearer. Specifically, the first elastomeric band 130 exercises or strengthens the muscles of the arch (i.e., the tibialis anterior, tibialis posterior, fibularis longus, fibularis brevis, fibularis tertius, flexor digitorum longus, flexor digitorum brevis, flexor hallucis longus muscles, and abductor hallucis muscles) and reduces stress on the ligaments of all the involved articulations. The second elastomeric band 140 strengthens the dorsiflexor of the foot and toes (i.e., the extensor hallucis longus, the extensor digitorum, the extensor digitorum brevis, the dorsal interosseous, and the peroneus tertius).

FIGS. 26 through 35 illustrate various views of socks for the left foot and the right foot of a wearer, which may be used to exercise ankle eversion and to correct excessive ankle inversion of the wearer's feet. FIGS. 26 through 30 respectively illustrate the inside side view, the outside side view, the top view, the bottom view, and the back view of the left sock 200L, while FIGS. 31 through 35 illustrate similar views of the right sock 200R.

"Ankle inversion" refers to the twisting of the foot inwards, which can lead to inversion ankle sprains. About 90% of ankle sprains are inversion injuries, which are caused when the outer ankle ligaments are stretched too far. In addition to the pain of a sprain, which can last from days to weeks, the person suffering the sprain may experience the inconvenience of limited mobility and may require rest, ice, and elevation of the sprained ankle.

As shown in FIGS. 26 through 35, a sock 200 has a body 220 made of a textile material (e.g., a knitted fabric) that surrounds the wearer's foot. The sock 200 includes an opening 221 through which the wearer inserts his/her foot and which forms a terminal end of the body 220. The sock 200 includes a first reinforcement strip 260 that circumscribes the upper portion of the sock 200 around or slightly above the wearer's ankle. A second reinforcement strip 270 is positioned between a mid-foot portion 224 and a toe portion 222 of the sock 200. The reinforcement strips 260, 270 may be dense bands of material, which are integral with the body 220 of the sock 200.

A first section 230*a* of a first elastomeric band 230 joins the first reinforcement strip 260 on a heel portion 228 on an inside side of the sock 200 (FIGS. 30 and 35) and wraps across the inside side of the sock (FIGS. 26 and 31). A second section 230*b* of the first elastomeric band 230 extends under the sock 200 between the heel portion 228 and the mid-foot portion 224 (FIGS. 26 and 31) and connects to the second reinforcement strip 270 on the bottom of the sock 200 toward an outside side of the sock 200 (FIGS. 29 and 34). The sections 230*a* and 230*b* are continuous and integral with one another in the first elastomeric band 230. It should be noted that the first elastomeric band 230 remains flat within the body 220 of the sock 200 without any twists in the first elastomeric band 230. In one embodiment, a thickness of therapeutic sock 200 at all points of first elastomeric band 230 is defined completely by a combination of a thickness of textile body 220 and a thickness of first elastomeric band 230.

A first section 240*a* of a second elastomeric band 240 joins the first reinforcement strip 260 on the heel portion 228 on the outside side of the sock 200 (FIGS. 30 and 35) and wraps from the outside side of the sock 200 (FIGS. 27 and 32) over the top of the sock 200 (FIGS. 28 and 33). A second section 240*b* of the second elastomeric band 240 extends under the bottom of the sock 200 to join the second reinforcement strip 270 near the inside side of the sock 200 (FIGS. 29 and 34). The sections 240*a* and 240*b* are continuous and integral with one another in the second elastomeric band 240. It should be noted that the second elastomeric band 240 remains flat within the body 220 of the sock 200 without any twists in the second elastomeric band 240. In one embodiment, a thickness of therapeutic sock 200 at all points of second elastomeric band 240 is defined completely by a combination of a thickness of textile body 220 and a thickness of second elastomeric band 240.

Specifically, the combination of the first elastomeric band 230 and the second elastomeric band 240 with the first reinforcement strip 260 and the second reinforcement strip 270 exercise or strengthen the eversion muscles (i.e., the peroneus longus, the peroneus brevis, the peroneus tertius, the extensor digitorum muscles).

Advantageously, if sock 200L is worn on the right foot instead, the sock 200L can be used to stabilize the wearer's right foot against ankle eversion, since the second elastomeric band 240 provides resistance against such movement and supports the foot. Similarly, the sock 200R can also be worn on the left foot for a similar purpose. In this instance, the socks (when reversed) are used to strengthen the inversion muscles (e.g., tibialis anterior and tibialis posterior).

FIGS. 36 through 40 illustrate a first embodiment of a left sock and a right sock, which may be used to strengthen the muscles necessary for ankle flexion of a wearer's foot. FIG. 36 illustrates an inside view of either a left sock or a right sock, according to the first embodiment. FIGS. 37 and 38 respectively illustrate top and bottom views of a left sock 300L, while FIGS. 39 and 40 provide similar views of the right sock 300R.

Ankle, or planar, flexion occurs when the superior surface (or dorsum) of the foot points downward (such as when depressing an accelerator in a car), thereby lengthening the dorsum in line with the leg. The range of motion is typically on the order of zero to fifty degrees. The socks 300, 302 of FIGS. 36 through 45 may be used to strengthen the muscles used in the ankle flexion movement, thereby maintaining a full range of motion and reducing the likelihood of strain or injury.

As shown in FIG. 36, a sock 300 includes a body 320 of a knitted material, which includes an opening 321 through which the wearer inserts his/her foot. A reinforcement strip 360 circumscribes the upper portion of the sock 300 around or slightly above the wearer's ankle. A first elastomeric band 330 encircles the toe portion 322 of the sock 300 on both the top surface (shown in FIGS. 37 and 39) and the bottom surface (shown in FIGS. 38 and 40). On the top surface, the first elastomeric band 330 includes a central section 330*a* and a toe section 330*b* that are integral with each other. The toe section 330*b* tapers from the inside side of the sock 300 and the outside side of the sock 300 toward the opening 321 and narrows at the central section 330*a*. On the bottom, or sole, of the sock 300, a toe section 330*c*, which is integral with the toe section 330*b*, extends over the toe portion 322 of the body 320 of the sock 300.

A second elastomeric band 340 connects to the first elastomeric band 330 on the top on the sock 300. On the top of the sock 300, the second elastomeric band 340 includes a central section 340*a*, which bifurcates into arcuate sections 340*b*, 340*c* that extend toward the toe portion 322. On the bottom of the sock 300, a single arcuate section 340*d* is disposed across the bottom surface and connects the arcuate sections 340*b*, 340*c*. The central section 340*a*, the arcuate sections 340*b*, 340*c*, and the arcuate section 340*d* are integral with one another.

A third elastomeric band 350 is connected to the central section 340*a* of the second elastomeric band 340 and to the reinforcement strip 360. On the top of the sock 300, the third elastomeric band 350 includes a central section 350*a* that is aligned with the central section 330*a* of the first elastomeric band 330 and the central section 340*a* of the second elastomeric band 340. The central section 350*a* of the third elastomeric band 350 is joined to the reinforcement strip 360 on the top of the sock 300. Arcuate sections 350*b*, 350*c* extend from the central portion 350*a* toward the toe portion 322. On the bottom of the sock 300, a single arcuate section 350*d* is disposed across the bottom surface and connects the arcuate sections 350*b*, 350*c*. The central section 350*a*, the arcuate sections 350*b*, 350*c*, and the arcuate section 350*d* are integral with one another.

FIGS. 41 through 45 illustrate a second embodiment of a left sock and a right sock, which may alternately be used to strengthen the muscles necessary for ankle flexion of a wearer's foot. FIG. 41 illustrates an inside view of either a left sock or a right sock, according to the second embodiment. FIGS. 42 and 43 respectively illustrate top and bottom views of a left sock 302L, while FIGS. 44 and 45 provide similar views of the right sock 302R.

As shown in FIG. 41, a sock 302 includes a body 320 of a knitted material, which includes an opening 321 through which the wearer inserts his/her foot. A reinforcement strip 360 circumscribes the upper portion of the sock 300 around or slightly above the wearer's ankle. Whereas the sock 300 of FIGS. 36 through 40 includes a first elastomeric band 330, both the top surface and the bottom surface of the sock 302 include a plurality of elastomeric strips 332*a* through 332*e*, each of which is aligned with a respective one of the wearer's toes.

Like the sock 300, the sock 302 includes a first elastomeric band 342 and a second elastomeric band 352. On the top of the sock 300 (shown in FIGS. 42 and 44), the first elastomeric band 342 includes a central section 342*a*, which bifurcates into arcuate sections 342*b*, 342*c* that extend toward the toe portion 322. Each of the elastomeric strips 332*a* through 332*e* connects to the first elastomeric band 342 on the top on the sock 302. Thus, each of the elastomeric strips 332*a* through 332*e* have different lengths to accommodate joining to the arcuate sections 342*b*, 342*c* of the first elastomeric band 342. On the bottom of the sock 302 (shown in FIGS. 43 and 45), a single arcuate section 342*d* is disposed across the bottom surface and connects the arcuate sections 342*b*, 342*c*. The elastomeric strips 332*a* through 332*e* continue from the top of the sock 302 to the arcuate section 342*d* on the bottom of the sock 302.

A second elastomeric band 352 is connected to the central section 342*a* of the first elastomeric band 342 and to the reinforcement strip 360. On the top of the sock 300, the second elastomeric band 352 includes a central section 352*a* that is aligned with the central section 342*a* of the second elastomeric band 342. The central section 352*a* of the second elastomeric band 352 is joined to the reinforcement strip 360 on the top of the sock 300. Arcuate sections 352*b*, 352*c* extend from the central portion 352*a* toward the toe portion 322. On the bottom of the sock 300, a single arcuate section 352*d* is disposed across the bottom surface and connects the arcuate sections 352*b*, 352*c*.

The cooperative relationship among the elastomeric bands and the reinforcement strip in the embodiments of FIGS. 36 through 45 help to strengthen or exercise the muscles used to extend the superior surface of the foot in a downward direction, thereby strengthening the calf and the flexors of the mid-foot and toes, reducing the likelihood of injury or strain. Specifically, a first elastomeric band 330 or 332, a second elastomeric band 340 or 342, and a third elastomeric band 350 exercise or strengthen the flexors and resists dorsiflexion. More specifically, the elastomeric bands 330 or 332, 340 or 342, and 350 exercise or strengthen the soles, gastrocnemius, plantaris, flexor hallucis longus, flexor hallicus brevis, flexor digitorum longus, flexor digitorum brevis, tibialis posterior, fibularis longus, fibularis brevis, abductor hallucis, abductor digiti minimi, lumbrical, dorsal interossei, and quadratus plantae muscles.

FIGS. 46 through 50 illustrate a first embodiment of left and right socks, which may be used to strengthen or exercise the muscles necessary for ankle dorsiflexion of a wearer's foot. FIG. 46 provides an inside side view of either a left sock or a right sock, according to the first embodiment. FIGS. 47 and 48 respectively illustrate top and bottom views of a left sock 400L, while FIGS. 49 and 50 provide similar views of the right sock 400R. FIGS. 51 and 52 illustrate a second embodiment of a left sock 402 (that is, 402L), which may alternately be used to strengthen or exercise the muscles necessary for ankle dorsiflexion of the wearer's foot. Specifically, a first elastomeric band 430, a second elastomeric band 440, and a third elastomeric band 450 exercise or strengthen the dorsiflexors and resists flexion.

Ankle dorsiflexion occurs when the superior surface (or dorsum) of the foot points upward, thereby shortening the dorsum in line with the leg. The range of motion is typically on the order of zero to twenty degrees. The socks 400, 402 of FIGS. 46 through 52 may be used to strengthen the muscles used in the ankle dorsiflexion movement, thereby maintaining a full range of motion and reducing the likelihood of strain or injury. The socks 400, 402 include an arrangement of bifurcating first and second elastomeric bands that are disposed on the bottom, or sole, of the sock 400, 402. This placement of the elastomeric bands is opposite that described with respect to FIGS. 36-45 for strengthening the muscles used for ankle flexion, which is appropriate since ankle dorsiflexion is an opposite movement to ankle flexion.

As shown in FIG. 46, a sock 400 includes a body 420 of a knitted material, which includes an opening 421 through which the wearer inserts his/her foot. A reinforcement strip 460 circumscribes the upper portion of the sock 400 around or slightly above the wearer's ankle. A first elastomeric band 430 encircles the toe portion 422 of the sock 400 on both the top surface (shown in FIGS. 46 and 47) and the bottom surface (shown in FIG. 48). On the bottom surface, the first elastomeric band 430 includes a central section 430*a* and a toe section 430*b* that are integral with each other. The toe section 430*b* tapers from the inside side of the sock 400 and the outside side of the sock 400 toward the opening 421 and narrows at the central section 430*a*. On the top of the sock 400, a toe section 430*c*, which is integral with the toe section 430*b*, extends over the toe portion 422 of the body 420 of the sock 400.

A second elastomeric band 440 connects to the first elastomeric band 430 on the bottom of the sock 400. On the bottom of the sock 400, the second elastomeric band 440 includes a central section 440*a*, which bifurcates into arcuate sections 440*b*, 440*c* that extend toward the toe portion 422. On the top of the sock 400, a single arcuate section 440*d* is disposed across the bottom surface and connects the arcuate sections 440*b*, 440*c*. The central section 440*a*, the arcuate sections 440*b*, 440*c*, and the arcuate section 440*d* are integral with one another.

A third elastomeric band 450 is connected to the central section 440*a* of the second elastomeric band 440 and to the reinforcement strip 460 at the heel portion 428. On the top of the sock 400, the third elastomeric band 450 includes a central section 450*a* that is aligned with the central section 430*a* of the first elastomeric band 430 and that is aligned with and connected to the central section 440*a* of the second elastomeric band 440. The central section 450*a* of the third elastomeric band 450 is joined to the reinforcement strip 460 along the heel portion 428 from the bottom of the sock 400. Arcuate sections 450*b*, 450*c* extend from the central portion 450*a* toward the toe portion 422. On the top of the sock 400, a single arcuate section 450*d* is disposed across the top surface and connects the arcuate sections 450*b*, 450*c*. The central section 450*a*, the arcuate sections 450*b*, 450*c*, and the arcuate section 450*d* are integral with one another.

FIGS. 51 and 52 illustrate a second embodiment of left socks, which may be alternately be used to strengthen the muscles necessary for ankle dorsiflexion of a wearer's foot. FIGS. 51 and 52 are top and bottom views, respectively, of the left sock 402L. The right sock (not shown) is similarly constructed.

As shown in FIG. 51, a sock 402 includes a body 420 of a knitted material, which includes an opening 421 through which the wearer inserts his/her foot. A reinforcement strip 460 circumscribes the upper portion of the sock 400 around or slightly above the wearer's ankle. Whereas the sock 400 of FIGS. 46 through 50 includes a first elastomeric band 430, both the top surface and the bottom surface of the sock 402 include a plurality of elastomeric strips 432*a* through 432*e*, each of which is aligned with a respective one of the wearer's toes.

Like the sock 400, the sock 402 includes a first elastomeric band 442 and a second elastomeric band 452. Unlike the sock 400, the sock 402 includes a second reinforcement strip 470 located proximate to the toe portion 422.

On the bottom of the sock 400 (shown in FIG. 52), the first elastomeric band 442 includes a central section 442*a*, which bifurcates into arcuate sections 442*b*, 442*c* that extend toward the toe portion 422. Each of the elastomeric strips 432*a* through 432*e* connects to the first elastomeric band 442 on the bottom on the sock 402 and to the second reinforcement strip 470 on the top of the sock 402 (shown in FIG. 51). Thus, each of the elastomeric strips 432*a* through 432*e* have different lengths to accommodate joining to the arcuate sections 442*b*, 442*c* of the first elastomeric band 442.

On the top of the sock 402 (shown in FIG. 51), a single arcuate section 442*d* is disposed across the top surface and connects the arcuate sections 442*b*, 442*c*. The elastomeric strips 432*a* through 432*e* continue from the bottom of the sock 402 to the second reinforcement strip 470 on the top of the sock 402.

A second elastomeric band 452 is connected to the central section 442*a* of the first elastomeric band 442 and to the reinforcement strip 460 at the heel portion 428. On the bottom of the sock 402, the second elastomeric band 452 includes a central section 452*a* that is aligned with the central section 442*a* of the first elastomeric band 442. The central section 452*a* of the second elastomeric band 452 is joined to the reinforcement strip 460 on the heel portion 428 of the sock 402. Arcuate sections 452*b*, 452*c* extend from the central portion 452*a* toward the toe portion 422. On the top of the sock 402, a single arcuate section 452*d* is disposed across the top surface and connects the arcuate sections 452*b*, 452*c*.

The cooperative relationship among the elastomeric bands and the reinforcement strip(s) in the embodiments of FIGS. 46 through 52 help to strengthen or exercise the muscles used to move the superior surface of the foot in an upward direction (dorsiflex), thereby reducing the likelihood of injury or strain. Specifically, the elastomeric strips 432*a* through 432*e*, the first elastomeric band 442, and the second elastomeric band 452 exercise or strengthen the tibialis anterior, tibialis tertius, extensor hallucis longus, extensor hallucis brevis, extensor digitorum longus, and extensor digitorum brevis muscles.

FIGS. 53 through 59 illustrate left and right socks, which may be used to correct various problems with the toes of a wearer's foot, to strengthen plantar flexion and dorsiflexion of the toes, and to strengthen muscles on the top and bottom of the wearer's foot, according to another aspect provided herein. FIGS. 53 and 54 respectively illustrate top and bottom views of a left sock 500L, while FIGS. 55 and 56 illustrate similar views of a right sock 500R. FIG. 57 illustrates a front view of the right sock 500R of FIG. 55. FIG. 58 illustrates a back view of both the left sock 500L and the right sock 500R. FIG. 59 is a front view of a left sock 502L, which is an alternate version of the left sock 500L of FIGS. 53 and 54.

The socks 500, 502 of FIGS. 53 through 59 address various problems with the toes of a wearer's foot, including hammer toes, claw toes, and mallet toes, by stretching and strengthening appropriate muscles and by repositioning the toes to an appropriate position. "Hammer toe" is a foot condition in which the middle joint of the toe has an abnormal bend toward the floor. Often, the hammer toe affects the second toe (next to the big toe), and the affected toe may be painful or hard to move and may develop bunions, corns, or calluses. Hammer toe can be caused by wearing shoes with narrow toe boxes or high heels. "Mallet toe" is a foot condition in which the joint at the end of the toe buckles. The skin near the toenail tip may develop a painful corn that can eventually result in an ulcer. The toe can become red and swollen and can be extremely painful. Because the second toe is typically the longest, it is the most likely to be affected by mallet toe. "Claw toe" often affects the four smaller toes at the same time. The toes bend up at the joint where the toes and the foot meet. They bend down at the middle joints and at the joints nearest the tip of the toes. This causes the toes to curl down toward the floor, which can lead to bunions, corns, and calluses and which can make it difficult to find comfortable shoes.

A sock 500 includes a body 520 of a textile material (e.g., a knitted material), which includes an opening 521 through which the wearer inserts his/her foot. A first reinforcement strip 560 circumscribes the upper portion of the sock 500 around or slightly above the wearer's ankle. A second reinforcement strip 570 is positioned slightly forward of the toe portion 522 of the sock 500. In the embodiments in FIGS. 53 through 58, the sock 500 may be open-toed, as indicated by a dashed line at the toe portion 522 (that is, the toe portion 522 may include only elastomeric toe bands, as discussed below, without a continuation of the textile body 520 of the sock 500).

As shown in FIGS. 53 and 55, a first elastomeric band 530 is disposed on the top of the sock 500 and extends from the first reinforcement strip 560 to the second reinforcement strip 570. The first elastomeric band 530 bifurcates at the mid-foot portion 524 from a central section 530*a* to a first branch 530*b* and a second branch 530*c*, thereby forming a "Y"-shaped elastomeric band.

A second elastomeric band 540 is disposed on the bottom, or sole, of the sock 500 and the heel portion 528 of the sock 500. A first section 540*a* of the second elastomeric band 540 extends from the first reinforcement strip 560 at the heel portion 528 (shown in FIG. 58) and wraps onto the bottom of the sock 500. As shown in FIGS. 54 and 56, a second (central) section 540*b* of the second elastomeric band 540 extends from the heel portion 528 toward the mid-foot portion 524, where the second elastomeric band 540 bifurcates into a first branch 540*c* and a second branch 540*d*. The first branch 540*c* and the second branch 540*d* connect to the second reinforcement strip 570.

Referring again to FIGS. 53 and 55, the toe portion 522 of the sock 500 includes a first plurality of elastomeric toe bands 580 through 588, which extend within the interior of the sock 500 from the top of the sock 500 and which are configured to fit around each toe of the wearer's foot. Each elastomeric toe band 580, 582, 584, 586, and 588 includes a first section labeled "a", a second section labeled "b", and a third section labeled "c." For example, an elastomeric toe band 580 includes a first section 580*a* that connects the second reinforcement strip 570, a second section 580*b* through which the wearer's big toe is positioned, and a third section 580*c* that forms a dome or cup (also shown in FIG. 57) around the nail of the big toe. Specifically, the second section 580*b* and the third section 580*c* surround the distal portions of the toes (that is, the middle toe joint and the toe nail, respectively). The other elastomeric toe bands 582 through 588 are similarly configured. The sections "a" through "c" of the elastomeric toe bands 580 through 588 provide a gentle upward force on the toes, thereby alleviating and/or correcting, or preventing altogether, the hammer toe, claw toe, or mallet toe issues experienced by the wearer.

As shown in FIGS. 54 and 56, a second plurality of elastomeric toe bands 590 through 598 extend within the interior of the sock 500 from the second reinforcement strip 570 on the bottom of the sock 500. Each elastomeric toe band 590 through 598 is configured to fit around each toe of the wearer's foot. Each elastomeric toe band 590, 592, 594, 596, and 598 includes a first section labeled "a" and a second section labeled "b." For example, an elastomeric toe band 590 includes a first section 590*a* that connects the second reinforcement strip 570 and a second section 590*b* through which the wearer's big toe is positioned. Specifically, the "b" sections surround the toe joint that is proximate to the foot (that is, proximate to the second reinforcement strip 570). The other elastomeric toe bands 592 through 598 are similarly configured. The sections "a" and "b" of the elastomeric toe bands 590 through 598 provide a gentle downward force on the proximal joints of the toes, thereby working cooperatively with the elastomeric toe bands 580 through 588 that provide an upward force on the distal joints of the toes to alleviate and/or correct the hammer toe, claw toe, or mallet toe issues experienced by the wearer.

FIG. 59 provides a front view of a left sock 502, 502L, which is similar to that shown in FIGS. 53, 55, and 57. In sock 502L, in addition to the elastomeric toe bands 580 through 588 connected to the second reinforcement strip 570, separation panels 581, 583, 585, and 587 extend from the second reinforcement strip 570 with each separation panel being disposed between respective pairs of adjacent toes. The separation panels 581 through 587 are positioned on the interior surface of the sock body 520 and help to keep the toes separated from one another and in their respective elastomeric toe bands 580 through 588, as well as within respective elastomeric toe bands 590 through 598.

The combination of elastomeric bands 530, 540, reinforcement strips 560, 570, and the first and second pluralities of elastomeric toe bands 580-588(*a-c*), 590-590(*a-b*) provide resistance against the proximal and distal joints of the toes, thereby correcting various toe problems, such as hammer toe, claw toe, or mallet toe. Specifically, the elastomeric bands 530, 540, 580-588, and 590-598 exercise or strengthen the soles, gastrocnemius, plantars, tibialis posterior, tibialis anterior, flexor hallucis longus, flexor hallicus brevis, flexor digitorum longus, flexor digitorum brevis, fibularis longus, fibularis brevis, fibularis tertius, extensor hallucis longus, extensor hallucis brevis, extensor digitorum longus, extensor digitorum brevis, abductor hallucis, abductor digiti minimi, lumbrical, dorsal interossei, and quadratus plantae.

FIGS. 60 through 69 illustrate various views of a left sock and a right sock, which may be used to address excessive external tibial torsion and to resist internal tibial torsion. According to a first embodiment, FIGS. 60 through 64 respectively illustrate an inside side view, an outside side view, a top view, a bottom view, and a back view of a left sock 600L, while FIGS. 65 through 69 respectively illustrate similar views of a right sock 600R.

Excessive external tibial torsion is a condition in which the lower leg bone (tibia) rotates excessively to the outside, when compared to the upper leg bone (femur). For instance, such rotation may occur over time with a person's right foot, which is rotated outwardly to depress the accelerator in a vehicle. As a result, the toes rotate outwardly, and the person affected by external tibial torsion has an out-toeing gait. Males and females are affected equally. External tibial torsion can lead to knee problems, symptomatic flat feet, and tarsal (toe) problems, which can make exercising difficult without risk of injury.

A sock 600 has a body 620 made of a textile material (e.g., a knitted fabric) that surrounds the wearer's foot. The body 620 has an opening 621 through which the wearer inserts his/her foot. An elastomeric band 630 is integral with the body 620 of the sock 600 and wraps around the fore-foot and between the mid-foot portion and the toe portion. The elastomeric band 630 includes a first section 630*a* starting at the heel portion 628 (shown in FIGS. 64 and 69). The first section 630*a* of the elastomeric band 630 wraps across the inside side of the sock (shown in FIGS. 60 and 65), over the top of the sock 600 (as shown in FIGS. 62 and 67), and across the outside side of the sock (shown in FIGS. 61 and 66) where the first section 630*a* intersects with a second section 630*b* and a third section 630*c*.

As shown in FIGS. 61 and 66, a second section 630*b* of the elastomeric band 630 extends from the first section 630*a* at the heel portion 628. The second section 630*b* extends along the outside side of the sock 600 toward the toe portion 622. While the second section 630*b* is disposed on the top surface of the sock 600 (as shown in FIGS. 61 and 66), the third section 630*c* is disposed on the bottom of the sock 600 (as shown in FIGS. 63 and 68) and extends along the same length as the second section 630*b* from the heel portion 628 toward the toe portion 622.

At a location between the mid-foot portion 624 and the toe portion 622, the second section 630*b* of the elastomeric band 630 connects to a fourth section 630*d* of the second elastomeric band 640 at a junction 635 on the outside side of the sock 600 (shown in FIGS. 61 and 66). The fourth section 630*d* of the elastomeric band 630 wraps across the top of the sock 600 (shown in FIGS. 62 and 67), around the inside side of the sock 600, and becomes fifth section 630*e* that extends across the bottom of the sock 600 (shown in FIGS. 63 and 68). The fourth section 630*d* connects to the fifth section 630*e* on the outside side of the sock 600 at a junction 637.

The positioning of the elastomeric band 630 of FIGS. 60 through 69 provides resistance against the external tibial rotation by helping to strengthen or exercise the muscles used to rotate the foot in an inward direction. Specifically, the sock 600 exercises or strengthens the popliteus, gracilis, semi-membranosis, semi-tendinosis, and sartorial muscles and rotates the tibia medial with the knee bent at a 90-degree angle or with the femur in a fixed position. As a result, the tibia and foot are brought into proper alignment, thereby reducing the likelihood of injury or strain of the knee or foot.

FIGS. 70 through 74 respectively illustrate an inside side view, an outside side view, a top view, a bottom view, and a back view of a right sock, which may also be used to address internal tibial torsion and/or to correct bunions.

Internal tibial torsion is a condition in which the lower leg bone (tibia) rotates excessively to the inside, when compared to the upper leg bone (femur). This condition is less common than external tibial torsion, but this condition can lead to similar types of pain and potential for injuries.

A sock 700 has a body 720 made of a textile material (e.g., a knitted fabric) that surrounds the wearer's foot. The body 720 has an opening 721 through which the wearer inserts his/her foot. An elastomeric band 730 is integral with the body 720 of the sock 700 and wraps around the fore-foot and between the mid-foot portion and the toe portion. The elastomeric band 730 includes a first section 730*a* that begins at the heel portion 728 (shown in FIG. 74). The first section 730*a* of the elastomeric band 730 wraps across the outside side of the sock 700 (shown in FIG. 71), over the top of the sock 700 (as shown in FIG. 72), and across the inside side of the sock (shown in FIG. 70) where the first section 730*a* intersects with a second section 730*b* and a third section 730*c*.

As shown in FIG. 70, the second section 730*b* of the elastomeric band 730 extends from the first section 730*a* at the heel portion 728. The second section 730*b* extends along the inside side of the sock 700 toward the toe portion 722. While the second section 730*b* is disposed on the top surface of the sock 700 (as shown in FIG. 70), the third section 730*c* is disposed on the bottom of the sock 700 (as shown in FIG. 73) and extends along the same length as the second section 730*b* from the heel portion 728 toward the toe portion 722.

At a location between the mid-foot portion 724 and the toe portion 722, the second section 730*b* of the elastomeric band 730 connects to a fourth section 730*d* of the elastomeric band 730 at a junction 735 on the inside side of the sock 700 (shown in FIG. 70). The fourth section 730*d* of the elastomeric band 730 molds around the big toe and extends into a fifth section 730*e* that wraps across the top of the sock 700 (shown in FIG. 72) and around the outside side of the sock 700. A sixth section 730*f* extends across the bottom of the sock 700 (shown in FIG. 73) and merges into a seventh section 730*g* that molds around the bottom of the big toe. The seventh section 730*g* connects to the fourth section 730*d* on the inside side of the sock 700 at a junction 737 (shown in FIG. 70). The partial loop of the fourth section 730*d* and the seventh section 730*g* corrects or prevents a bunion on the big toe, which might otherwise cause the big toe to curve outward toward the little toe.

The cooperative relationship among, and the positioning of, the sections of the elastomeric band 730 of FIGS. 70 through 74 provide resistance against the internal tibial rotation by helping to strengthen or exercise the muscles used to rotate the foot in an inward direction. Specifically, the sock 700 exercises or strengthens the tensor fasciae latae, biceps femoris, vastus lateralis, lateral gastrocnemius. As a result, the tibia and foot are brought into proper alignment, thereby reducing the likelihood of injury or strain of the knee or foot. Additionally, the abductor hallucis can be stretched to reduce bunion formation.

Reference made herein to various muscle groups that are supported or strengthened by the present embodiments of therapeutic socks should not be considered exhaustive. In some instances, additional muscle groups that are not specifically mentioned may benefit from a given sock construction.

While preferred embodiments of the present multi-function therapeutic socks have been shown and described, modifications and variations may be made thereto without departing from the spirit and scope of the present disclosure. Thus, it should be understood that various embodiments may be interchanged, both in whole or in part. Furthermore, those with skill in this technology will appreciate that the foregoing description is by way of example only and is not intended to be a limitation of the invention as further described in the appended claims.

What is claimed is:

1. A therapeutic sock comprising:

a textile body having a top, a bottom opposite the top, an inside side connecting the top to the bottom, an outside side opposite the inside side and connecting the top to the bottom, a heel portion, a toe portion, and an opening configured for insertion of a foot of a wearer; and at least one elastomeric band within the textile body and configured to be positioned to strengthen, stretch, or support one or more muscle groups of the foot of the wearer, wherein the at least one elastomeric band comprises a first elastomeric band and a second elastomeric band, and each elastomeric band of the at least one elastomeric band is disposed opposite a line of pull of the one or more muscle groups to strengthen the one or muscle groups by providing resistance when the wearer moves the foot in a prescribed manner;

a first reinforcement strip, the first reinforcement strip being a first dense band of textile material integral with the textile body, and entirely circumscribing the opening of the textile body;

a second reinforcement strip disposed proximate to the toe portion of the textile body, wherein the second reinforcement strip is a second dense band of textile material integral with the textile body;

wherein the first elastomeric band of the at least one elastomeric band connects at a junction to the first reinforcement strip;

wherein a thickness of the therapeutic sock at all points of the first elastomeric band is defined completely by a combination of a thickness of the textile body and a thickness of the first elastomeric band, and a thickness of the therapeutic sock at all points of the second elastomeric band is defined completely by a combination of the thickness of the textile body and a thickness of the second elastomeric band; and wherein an arrangement of the first elastomeric band, the second elastomeric band, the first reinforcement strip, and the second reinforcement strip are configured to address a musculoskeletal disorder of the foot of the wearer.

2. The therapeutic sock of claim 1, wherein the first elastomeric band wraps around a mid-foot portion of the textile body between the heel portion and the toe portion.

3. The therapeutic sock of claim 1, wherein the first elastomeric band comprises a first section extending across the inside side of the textile body from the heel portion to a mid-foot portion between the heel portion and a toe portion, a second section extending across the bottom of the textile body from the mid-foot portion to a position between a big toe and a second toe of the toe portion, a third section extending across the top of the textile body from between the big toe and the second toe of the toe portion, and a fourth section extending around the heel portion of the textile body and connecting the first section.

4. The therapeutic sock of claim 1, wherein the first elastomeric band has a first section connected to the first reinforcement strip at the heel portion and extending along the inside side of the textile body toward a mid-foot portion of the textile body and a second section extending along the bottom of the textile body to the second reinforcement strip.

5. The therapeutic sock of claim 4, wherein the second elastomeric band has a first section connected to the first reinforcement strip at the heel portion and extending along the outside side of the textile body and over the top of the textile body toward the second reinforcement strip, and the second elastomeric band has a second section disposed on the bottom of the textile body and connected to the second reinforcement strip.

6. The therapeutic sock of claim 5, wherein the first elastomeric band and the second elastomeric band of the at least one elastomeric band are configured to be positioned on the foot of the wearer to exercise ankle eversion and to correct excessive ankle inversion of the foot of the wearer.

7. The therapeutic sock of claim 6, wherein the one or more muscle groups configured to be strengthened, stretched, or exercised include one or more of the peroneus longus, the peroneus *brevis*, the peroneus tertius, and the extensor digitorum muscles.

8. The therapeutic sock of claim 1, wherein a first section of the first elastomeric band is connected to the first reinforcement strip on the top of the textile body; wherein the first elastomeric band bifurcates from the first section into a second section extending over the top toward the outside side of the textile body and a third section extending over the top toward the inside side of the textile body; and wherein a fourth section of the first elastomeric band extends over the bottom of the textile body and connects the second section and the third section.

9. The therapeutic sock of claim 8, wherein the at least one elastomeric band comprises the first elastomeric band and the second elastomeric band; wherein a first section of the second elastomeric band is connected to the first section of the first elastomeric band on the top of the textile body; wherein the second elastomeric band bifurcates from the first section into a second section extending over the top toward the outside side of the textile body and a third section extending over the top toward the inside side of the textile body; and wherein a fourth section of the second elastomeric band extends over the bottom of the textile body and connects the second section and the third section of the second elastomeric band.

10. The therapeutic sock of claim 9, wherein the at least one elastomeric band comprises the first elastomeric band, the second elastomeric band, and a third elastomeric band; wherein a first section of the third elastomeric band connects to the first section of the second elastomeric band on the top of the textile body, a second section of the third elastomeric band converges outward from the first section to encompass the toe portion on the top of the textile body, and a third portion of the third elastomeric band extends over the toe portion on the bottom of the textile body.

11. The therapeutic sock of claim 9, wherein the at least one elastomeric band comprises the first elastomeric band, the second elastomeric band, and a plurality of third elastomeric bands; wherein each of the third elastomeric bands is aligned with each respective toe within the toe portion and extends from the second elastomeric band on the top of the textile body to the fourth portion of the second elastomeric band on the bottom of the textile body.

12. The therapeutic sock of claim 1, wherein a first section of the first elastomeric band is connected to the first reinforcement strip at the heel portion of the textile body and extends onto the bottom of the textile body; wherein the first elastomeric band bifurcates from the first section into a second section extending over the bottom toward the outside side of the textile body and a third section extending over the bottom toward the inside side of the textile body; and wherein a fourth section of the first elastomeric band extends over the top of the textile body and connects the second section and the third section.

13. The therapeutic sock of claim 12, wherein the at least one elastomeric band comprises the first elastomeric band and the second elastomeric band; wherein a first section of the second elastomeric band is connected to the first section of the first elastomeric band on the bottom of the textile body; wherein the second elastomeric band bifurcates from the first section into a second section extending over the bottom toward the outside side of the textile body and a third section extending over the bottom toward the inside side of the textile body; and wherein a fourth section of the second elastomeric band extends over the top of the textile body and connects the second section and the third section of the second elastomeric band.

14. The therapeutic sock of claim 13, wherein the at least one elastomeric band comprises the first elastomeric band, the second elastomeric band, and a third elastomeric band; wherein a first section of the third elastomeric band connects to the first section of the second elastomeric band on the bottom of the textile body, a second section of the third elastomeric band converges outward from the first section to encompass the toe portion on the bottom of the textile body, and a third portion of the third elastomeric band extends over the toe portion on the top of the textile body.

15. The therapeutic sock of claim 13, wherein the at least one elastomeric band comprises the first elastomeric band, the second elastomeric band, and a plurality of third elastomeric bands; wherein each of the third elastomeric bands is aligned with each respective toe within the toe portion and extends from the second elastomeric band on the bottom of the textile body to the second reinforcement strip on the top of the textile body.

16. The therapeutic sock of claim 1, wherein the first elastomeric band extends from the first reinforcement strip to the second reinforcement strip over the top of the textile body; and wherein a first section of the first elastomeric band is connected to the first reinforcement strip, the first section bifurcating into a second section extending toward the outside side of the textile body and a third section extending toward the inside side of the textile body.

17. The therapeutic sock of claim 16, wherein the at least one elastomeric band comprises the first elastomeric band and the second elastomeric band; wherein a first section of the second elastomeric band extends from the first reinforcement strip along the heel portion to the bottom of the textile body, the second elastomeric band having a second section continuous from the first section and extending along the bottom of the textile body; and wherein the second section of the second elastomeric band bifurcates into a third section extending toward the outside side of the textile body and a fourth section extending toward the inside side of the textile body, the third section and the fourth section connecting to the second reinforcement strip on the bottom of the textile body.

18. The therapeutic sock of claim 16, wherein the at least one elastomeric band comprises a first plurality of elastomeric toe bands extending within an interior of the textile body from the top of the textile body, each elastomeric toe band of the first plurality of elastomeric toe bands including a first section connected to the second reinforcement strip on the top of the textile body, a second section configured to fit around a respective toe of the wearer's foot, and a third section forming a dome around the nail of the respective toe; wherein the at least one elastomeric band comprises a second plurality of elastomeric toe bands extending within the interior of the textile body from the bottom of the textile body, each elastomeric toe band of the second plurality of elastomeric toe bands including a first section connected to the second reinforcement strip on the bottom of the textile body and a second section configured to fit around the respective toe of the wearer's foot; and wherein the second plurality of elastomeric toe bands is configured to fit around proximal joints of the respective toes of the wearer's foot, and the first plurality of elastomeric toe bands is configured to fit around the distal joints of the respective toes of the wearer's foot.

19. The therapeutic sock of claim 1, wherein the first elastomeric band extends from the top of textile body to the bottom of the textile body or extends from the bottom of the textile body to the top of the textile body.

20. The therapeutic sock of claim 1, wherein the first reinforcement strip circumscribes an upper portion of the textile body and is configured to be positioned around or slightly above an ankle of the wearer.

21. The therapeutic sock of claim 1, wherein the second reinforcement strip is positioned between a mid-foot portion and the toe portion of the textile body.

* * * * *